US012504019B2

(12) United States Patent
Jang et al.

(10) Patent No.: US 12,504,019 B2
(45) Date of Patent: Dec. 23, 2025

(54) BLOWER

(71) Applicant: LG ELECTRONICS INC., Seoul (KR)

(72) Inventors: Hosik Jang, Seoul (KR); Seungho Baek, Seoul (KR); Haein Jung, Seoul (KR); Kibbum Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 543 days.

(21) Appl. No.: 17/925,706

(22) PCT Filed: Oct. 22, 2020

(86) PCT No.: PCT/KR2020/014510

§ 371 (c)(1),
(2) Date: Nov. 16, 2022

(87) PCT Pub. No.: WO2021/235619

PCT Pub. Date: Nov. 25, 2021

(65) Prior Publication Data

US 2023/0340960 A1 Oct. 26, 2023

(30) Foreign Application Priority Data

May 18, 2020 (KR) ..... 10-2020-0059158
May 18, 2020 (KR) ..... 10-2020-0059159
Sep. 8, 2020 (KR) ..... 10-2020-0114464

(51) Int. Cl.
*F04D 25/10* (2006.01)
*F04D 25/08* (2006.01)
(Continued)

(52) U.S. Cl.
CPC ..... *F04D 25/08* (2013.01); *F04D 25/10* (2013.01); *F04D 29/42* (2013.01); *F04F 5/16* (2013.01)

(58) Field of Classification Search
CPC ..... F04D 19/002; F04D 25/08; F04D 25/10; F04D 27/002; F04D 29/42; F04D 25/16; F04F 5/16
See application file for complete search history.

(56) References Cited

U.S. PATENT DOCUMENTS 2,488,467 A * 11/1949 De Lisio ..... F04D 25/08 239/561
2,583,374 A * 1/1952 Hoffman ..... F04F 5/16 454/351
(Continued)

FOREIGN PATENT DOCUMENTS

CN 104863871 8/2015
CN 104863871 A * 8/2015 ..... F04F 5/466
(Continued)

OTHER PUBLICATIONS

Korean Office Action dated Apr. 6, 2023 issued in Application No. 10-2020-0114464.
(Continued)

*Primary Examiner* — Thomas Fink
(74) *Attorney, Agent, or Firm* — KED & ASSOCIATES, LLP

(57) ABSTRACT

A blower is disclosed. The blower of the present disclosure comprises: a fan for producing an air flow; a lower body providing an inner space in which the fan is installed and having an intake hole through which air passes; a side body disposed on the lower body and providing an inner space in which air discharged from the fan flows; and a rear body disposed at the rear of the side body, wherein: the side body includes an opening formed at the rear end of the side body and communicating with the inner space of the side body; and the rear body covers a part of the side body at the rear of the opening.

15 Claims, 18 Drawing Sheets

(51) Int. Cl.
*F04D 29/42* (2006.01)
*F04F 5/16* (2006.01)

(56) References Cited

U.S. PATENT DOCUMENTS

| | | | | |
|---|---|---|---|---|
| 2015/0136997 | A1 | 5/2015 | Kubo et al. | |
| 2019/0301475 | A1* | 10/2019 | De' Longhi | F04D 29/541 |

FOREIGN PATENT DOCUMENTS

| | | |
|---|---|---|
| EP | 3458721 | 5/2020 |
| JP | 2013-213454 | 10/2013 |
| JP | 2019-522138 | 8/2019 |
| KR | 10-2011-0099318 | 9/2011 |
| KR | 10-2013-0045421 | 5/2013 |
| KR | 10-2017-0066025 | 6/2017 |
| KR | 10-2018-0125425 | 11/2018 |
| KR | 10-2019-0142280 | 12/2019 |
| WO | WO 2017/069437 | 4/2017 |

OTHER PUBLICATIONS

International Search Report dated Feb. 3, 2021 issued in Application No. PCT/KR2020/014510.
European Search Report dated Apr. 24, 2024 issued in Application No. 20936532.9.

* cited by examiner

BLOWER

CROSS-REFERENCE TO RELATED PATENT APPLICATIONS

This application is a U.S. National Stage Application under 35 U.S.C. § 371 of PCT Application No. PCT/KR2020/014510, filed Oct. 22, 2020, which claims priority to Korean Patent Application Nos. 10-2020-0059158, filed May 18, 2020, 10-2020-0059159, filed May 18, 2020 and 10-2020-0114464, filed Sep. 8, 2020, whose entire disclosures are hereby incorporated by reference.

BACKGROUND

Field of the Invention

The present disclosure relates to a blower. In particular, the present disclosure relates to a blower capable of variously adjusting a wind direction of air.

Related Art

A blower can create an air flow to circulate air in an indoor space or create an air flow toward a user. Recently, a lot of research has been done on an air discharge structure of a blower that can give a user a pleasant feeling.

Korea Patent Application Laid-Open No. 10-2019-0142280 discloses a blower device. The blower device may directly provide air flowed by a fan to a user. In this case, although there is an advantage in that the air discharged from the blower device can be sent to a long distance, there is a problem in that an excessively strong air flow is provided to the user, which may cause discomfort to the user.

Korean Patent Application Laid-Open No. 10-2011-0099318 and Korean Patent Application Laid-Open No. 10-2013-0045421 disclose a fan that blows air using the Coanda effect. However, the fan has a problem in that the fan can discharge air only to a certain area. In addition, it is necessary to move or rotate the fan in order to change a wind direction, thereby consuming power or generating noise or vibration.

SUMMARY

The present disclosure aims to solve the above and other problems.

Another object may be to provide a blower that can indirectly provide a user with air discharged from a fan to give the user a pleasant feeling.

Another object may be to provide a blower capable of variously adjusting a wind direction of air in situ.

Another object may be to provide a blower capable of forming an air flow that is intensively discharged, or forming an air flow that is dispersedly or diffusely discharged.

Another object may be to provide a blower capable of circulating air in an indoor space by forming an updraft.

According to an aspect of the present disclosure, there is provided a blower including: a fan configured to generate an air flow; a lower body providing an inner space in which the fan is installed and having an intake hole through which air passes; a side body located on the lower body and providing an inner space in which air discharged from the fan flows; and a rear body located at the rear of the side body, in which the side body includes an opening formed at the rear end of the side body and communicating with the inner space of the side body, and the rear body covers a part of the side body at the rear of the opening.

According another aspect of the present disclosure, the side body may be elongated, the side body may further include: a first surface located on one side of the opening in a direction crossing a longitudinal direction of the side body; and a second surface located on the other side of the opening in the direction crossing the longitudinal direction of the side body, and the rear body may further include: a rear plate located at the rear of the opening; a first rear guide extending obliquely forward from one end of the rear plate and covering a part of the first surface; and a second rear guide extending obliquely forward from the other end of the rear plate and covering a part of the second surface.

According still another aspect of the present disclosure, the first surface and the second surface may be formed in a curved surface, a gap between the first rear guide and the first surface may become smaller toward the front, and a gap between the second rear guide and the second surface may become smaller toward the front.

According still another aspect of the present disclosure, the blower may further include a splinter coupled to a front surface of the rear plate between the opening and the rear plate, in which the splinter may include: a first inclined surface facing an end of the first surface and formed to be inclined with respect to the front surface of the rear plate; and a second inclined surface facing the end of the second surface and formed to be inclined with respect to the front surface of the rear plate.

According still another aspect of the present disclosure, the side body may further include: a first side body having a first rear end adjacent to the rear body; and a second side body having a second rear end adjacent to the rear body and spaced apart from the first rear end, and the opening may be formed between the first rear end and the second rear end.

According still another aspect of the present disclosure, the blower may further include: a slit formed in at least one of the first side body and the second side body; and a damper installed in the inner space of the side body and opening or closing the slit.

According still another aspect of the present disclosure, the slit may further include: a first slit passing through the first side body; and a second slit passing through the second side body, and the damper may further include: a first damper adjacent to the first side body and opening or closing the first slit; and a second damper adjacent to the second side body and opening or closing the second slit.

According still another aspect of the present disclosure, the damper may further include: a motor providing a rotational force; a link connected to a rotation shaft of the motor and pivotable about the rotation shaft of the motor; a body having a straight link hole into which an end of link is movably inserted and movable toward the slit; and a plate fixed to the body and having the same cross section as a shape of the slit.

According still another aspect of the present disclosure, the damper may further include: a protrusion protruding outward from the body and extending in a direction crossing a longitudinal direction of the link hole; and a damper guide to which the protrusion is linearly movably coupled.

According still another aspect of the present disclosure, the link may further include: an upper link; and a lower link located below the upper link, and a pivot direction of the upper link and a pivot direction of the lower link may be different or opposite to each other.

According still another aspect of the present disclosure, the body may provide an inner space into which a part of the plate is inserted and in which a light emitting element is installed.

According still another aspect of the present disclosure, the plate may be inserted into the slit to close the slit and disposed in parallel with an outer surface of the side body adjacent to the slit.

According still another aspect of the present disclosure, the plate may be inserted into the slit to close the slit and protrude outward from an outer surface of the side body adjacent to the slit.

According still another aspect of the present disclosure, the plate may be spaced apart from the slit to open the slit and disposed in the inner space of the slit body.

According still another aspect of the present disclosure, the blower may further include an upper body located above the lower body and providing an inner space connecting the inner space of the lower body and the inner space of the side body, in which the upper body may include a middle body covering a lower portion of the side body, and a hole may be formed between the side body and the middle body.

According still another aspect of the present disclosure, the blower may further include an inner damper installed in an inner space of the middle body and opening or closing the hole, in which the inner space of the middle body may form a flow path through which air discharged from the fan flows, the inner space of the side body may form a second flow path connected to the first flow path, and the hole may communicate with the flow path when the hole is opened by the damper.

According still another aspect of the present disclosure, the upper body may further include a bending part bent from the middle body toward the side body and disposed to be inclined with respect to the side body, and a gap between the side body and the bending part may become narrower upward.

According still another aspect of the present disclosure, the inner damper ma further include: a motor providing a rotational force; a pinion connected to a rotation shaft of the motor; a rack being elongated and engaging the pinion; and a cover to which the rack is fixed and which is disposed below the hole and movable in a longitudinal direction of the rack together with the rack, and the cover may come into contact with an inner surface of the middle body to close the hole or be spaced apart from the middle body to open the hole.

According still another aspect of the present disclosure, the inner damper may further include: a front rail installed on the cover and having a front slot elongated in the longitudinal direction of the rack; a rear rail installed on the cover, spaced apart from the front rail, and having a rear slot elongated in a longitudinal direction of the rack; a first pin fixed to the middle body and movably inserted into the front rail; and a second pin fixed to the middle body and movably inserted into the rear rail.

According still another aspect of the present disclosure, the inner damper may further include a mount on which the motor is installed and in which a mount hole communicating with the first flow path is formed, and the mount hole may be spaced apart from the hole in a moving direction of the cover.

Effects of the blower according to the present disclosure will be described as follows.

According to at least one of embodiments of the present disclosure, since the air discharged from the fan is indirectly provided to a user through a plurality of flow paths, it is possible to provide a blower that can give a user a pleasant feeling.

According to at least one of the embodiments of the present disclosure, without moving or rotating the blower, the wind direction of the air may be variously adjusted by opening or closing a slit and a hole through which the air discharged from the fan can pass.

According to at least one of the embodiments of the present disclosure, the air flowing forward along the side surface of the blower smoothly passes through the slit to form a concentrated air flow, or may interfere with air discharged from the slit or the plate protruding from the slit to a form disperse or diffused air flow.

According to at least one of the embodiments of the present disclosure, when the inner damper opens the hole formed in an up-down direction, the air discharged from the fan may form an updraft. Thereby, air can be circulated in the indoor space.

Further scope of applicability of the present disclosure will become apparent from the following detailed description. However, it should be understood that the detailed description and specific embodiments such as preferred embodiments of the present disclosure are given by way of example only, since various changes and modifications within the spirit and scope of the present disclosure may be clearly understood by those skilled in the art.

DESCRIPTION OF EXEMPLARY EMBODIMENTS

Figure 1:
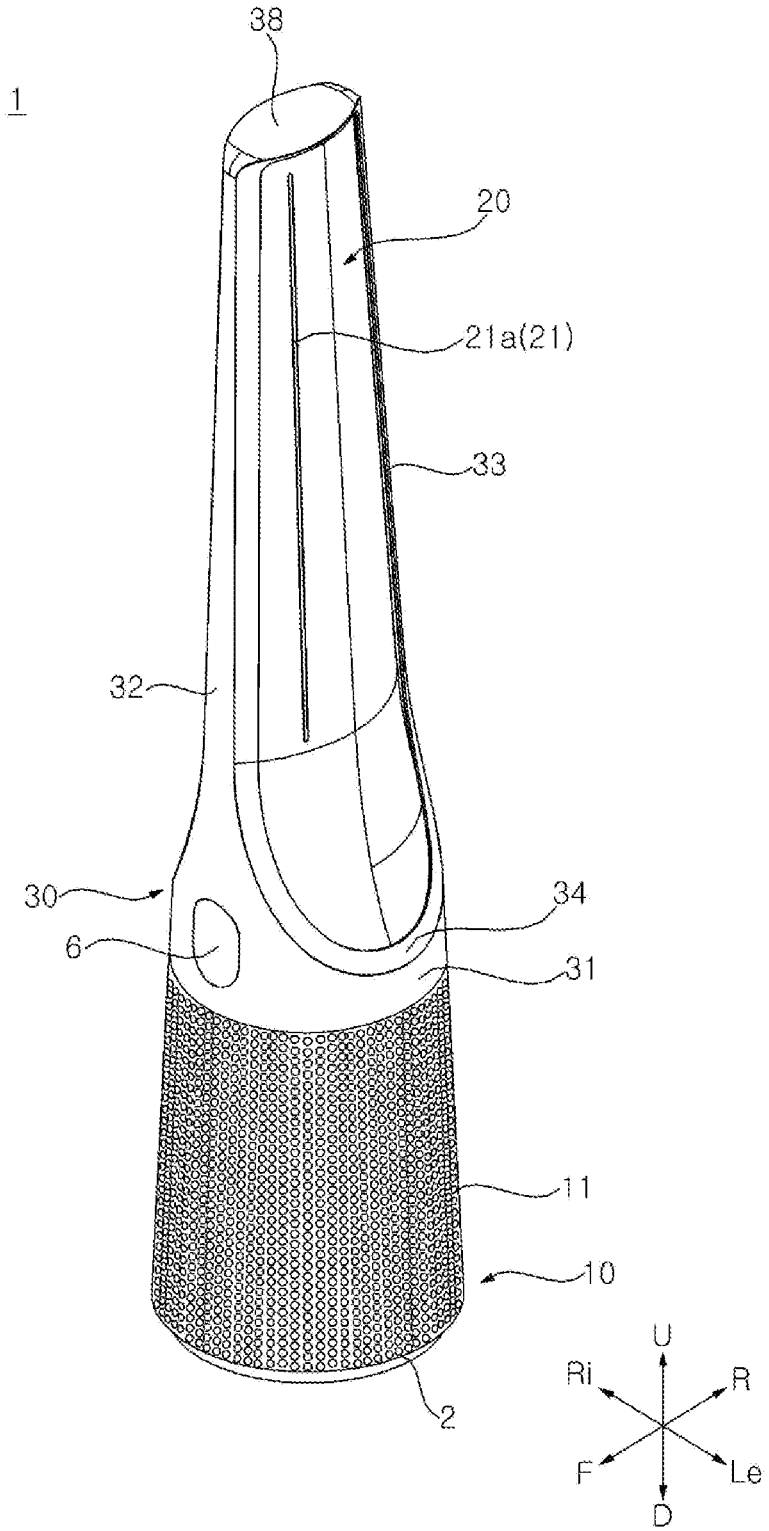
FIG. 1 is a perspective view of a blower according to one embodiment of the present disclosure.

Hereinafter, embodiments disclosed in the present specification will be described in detail with reference to the accompanying drawings, but the same or similar components are assigned the same reference numerals regardless of reference numerals, and redundant description thereof will be omitted.

In describing the embodiments disclosed in the present specification, when it is determined that detailed descriptions of related known technologies may obscure the gist of the embodiments disclosed in the present specification, the detailed description thereof will be omitted. In addition, the accompanying drawings are only for easy understanding of the embodiments disclosed in the present specification, the technical spirit disclosed in the present specification is not limited by the accompanying drawings, and it should be understood to include all modifications, equivalents, and substitutes included in the spirit and scope of the present disclosure.

Terms including an ordinal number such as first or, second may be used to describe various elements, but the elements are not limited by the terms. The above terms are used only for the purpose of distinguishing one component from another.

Direction indications of up (U), down (D), left (Le), right (Ri), before (F), and after (R) illustrated in the drawings are only for convenience of description, and thereby the disclosed technical idea is not limited by these.

Referring to FIG. 1, a blower 1 may extend long in an up-down direction. The blower 1 may include a base 2, a lower body 10, a side body 20, an upper body 30, and a top cover 38.

The base 2 forms a lower surface of the blower 1, and may be placed on a floor of an indoor space. The base 2 may be formed in a circular plate shape as a whole.

The lower body 10 may be disposed above the base 2. The lower body 10 may form a lower portion of a side surface of the blower 1. The lower body 10 may be formed in a cylindrical shape as a whole. For example, a diameter of the lower body 10 may be decreased from a lower portion to an upper portion of the lower body 10. For another example, a diameter of the lower body 10 may be kept constant in the up-down direction. An intake hole 11 may be formed on the side surface of the lower body 10. A plurality of intake holes 11 may be evenly arranged along a circumferential direction of the lower body 10 on an outer peripheral surface of the lower body 10. Therefore, air may be introduced from the outside of the blower 1 to the inside thereof through the plurality of intake holes 11.

The side body 20 may be disposed above the lower body 10. The side body 20 may form an upper portion of the surface of the blower 1. The side surface of the side body 20 may be provided with a curved surface. The side body 20 may be formed in an elliptic cylinder shape as a whole. In this case, an elliptical cross-section of the side body 20 may have a long axis parallel to a front-rear direction. In other words, a width of the side body 20 in the front-rear direction may be greater than the width of the side body 20 in a right-left direction. In addition, a cross-sectional area of the side body 20 may decrease from a lower portion to an upper portion of the side body 20. In other words, an inner space of the side body 20 may become narrower from the lower portion to the upper portion of the side body 20.

Meanwhile, a left surface of the side body 20 may be referred to as a first surface, and a right surface thereof may be referred to as a second surface. The first surface may be a curved surface convex to the left, and the second surface may be a curved surface convex to the right.

The upper body 30 may be disposed above the lower body 10. The upper body 30 may surround a part of the side body 20. The upper body 30 may cover the front and rear of the side body 20.

The top cover 38 may cover an upper surface of the side body 20 on the upper side of the side body 20. The top cover 38 may form an upper surface of the blower 1. The top cover 38 may be coupled to a front body 32 and a rear body 33 between the front body 32 and the rear body 33 to be described later.

Figure 2:
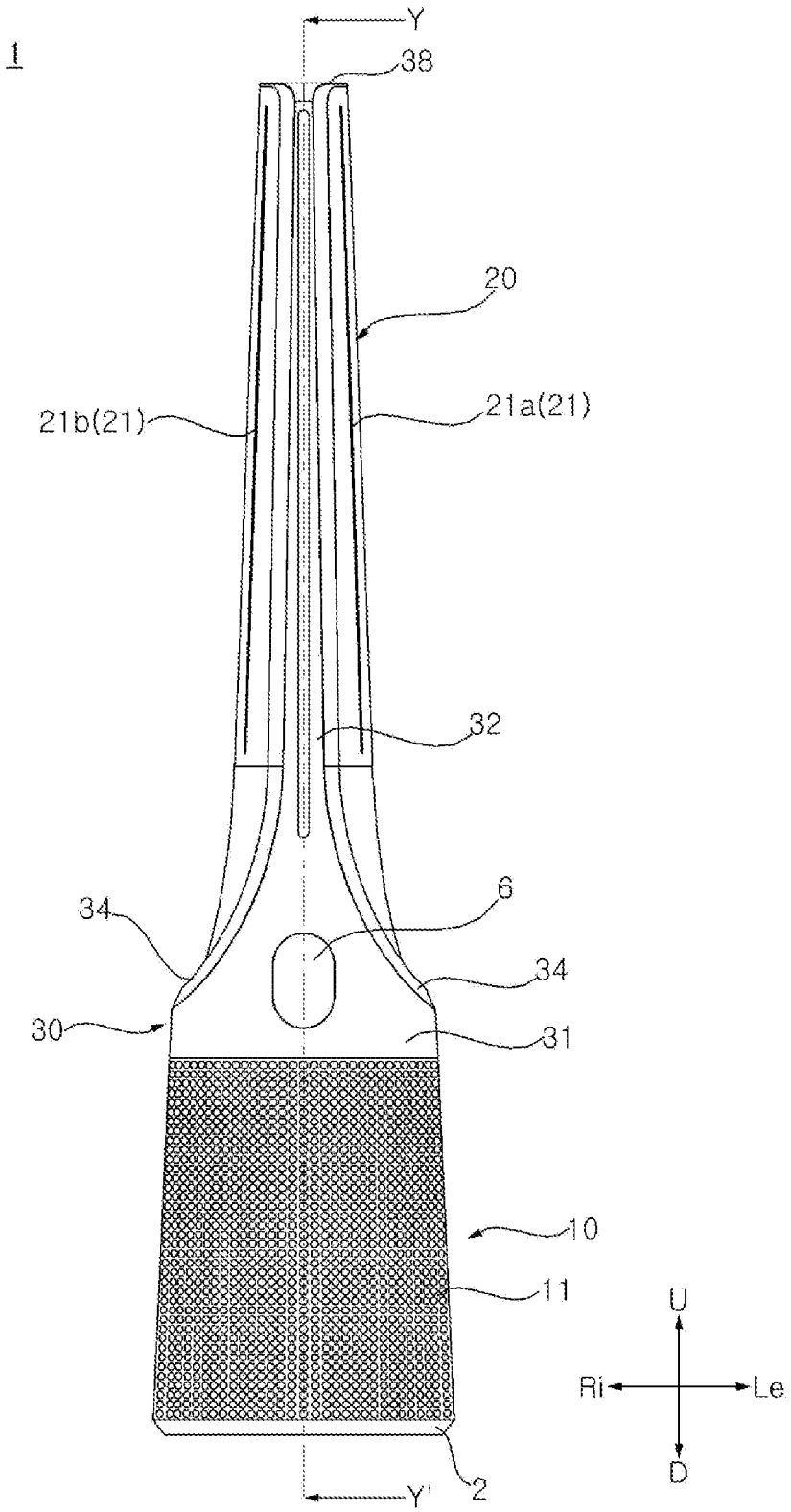
FIG. 2 is a front view of the blower according to one embodiment of the present disclosure.
Figure 3:
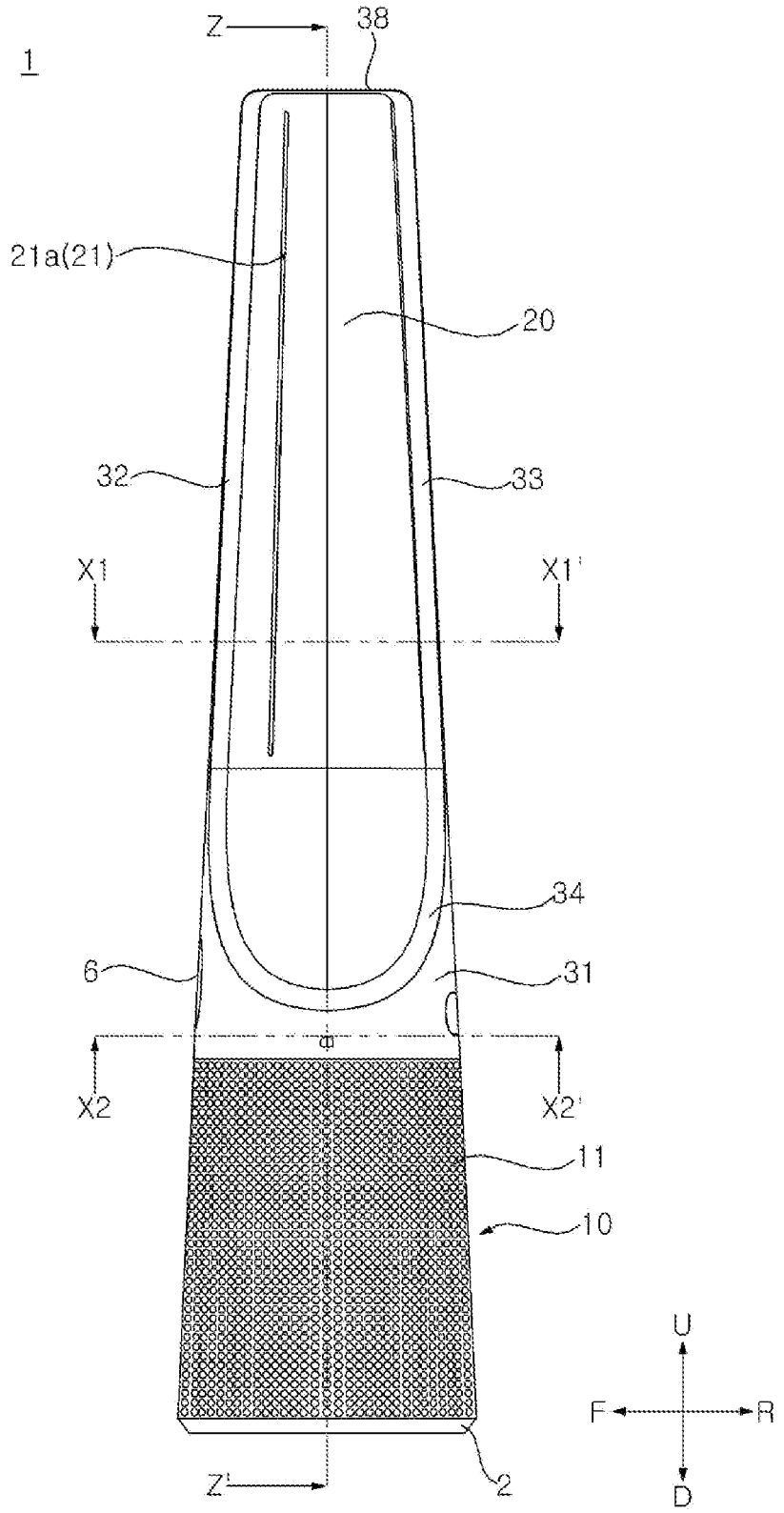
FIG. 3 is a left side view according to one embodiment of the present disclosure.

Referring to FIGS. 2 and 3, the upper body 30 may include a middle body 31, the front body 32, the rear body 33, and a bending part 34.

The middle body 31 may be disposed between the lower body 10 and the side body 20. The middle body 31 may cover a lower portion of the side body 20. The front body 32 may extend upwardly from a front portion of the middle body 31 to cover the front of the side body 20. In this case, the front body 32 may be coupled to the side body 20. The rear body 33 may extend upwardly from a rear portion of the middle body 31 to cover the rear of the side body 20. In this case, the rear body 33 may be spaced rearwardly from the side body 20, and will be described in more detail later. The bending part 34 may be bent toward the side body 20 from the left surface and right surface of the middle body 31. In this case, the bending part 34 is inclined toward the side body 20, and may be spaced apart from the side body 20, which will be described later in more detail.

Meanwhile, a slit 21 may be formed on at least one of the left surface and the right surface of the side body 20. For example, the slit 21 may be disposed closer to a front end than a rear end of the side body 20 on each of the left surface and the right surface of the side body 20. The slit 21 may be formed to be elongated in the up-down direction. In this case, the slit 21 may be opened or closed by a damper plate 92 (refer to FIGS. 6, 8, and 10) to be described later, which will be described later in more detail.

Meanwhile, the display 6 may be provided on the front surface of the middle body 31. For example, the display 6 may display operation information of the blower 1, or may provide an interface that can receive a command of a user.

Figure 4:
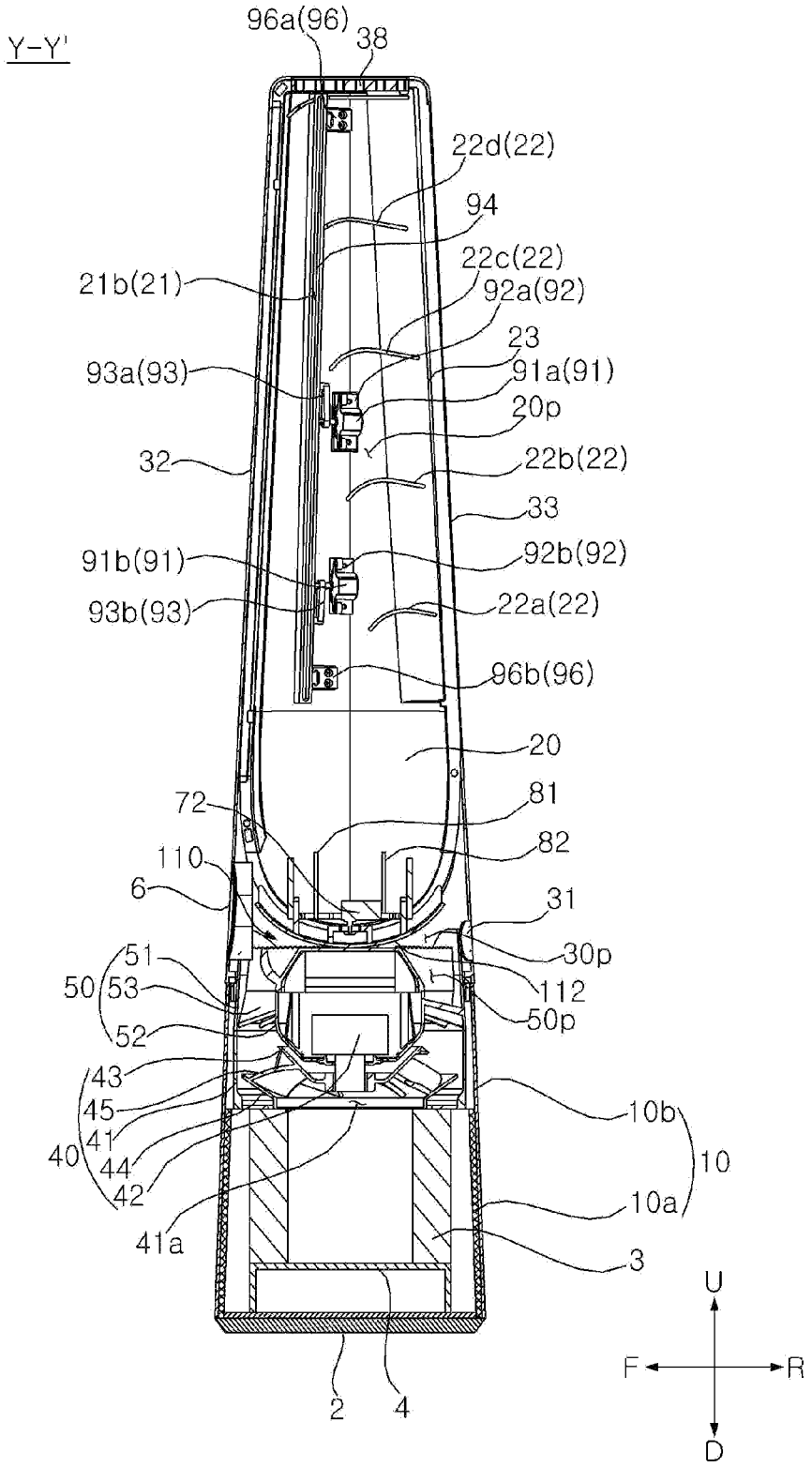
FIG. 4 is a cross-sectional view taken along line Y-Y' of FIG. 2.

Referring to FIG. 4, the lower body 10 may include a first lower body **10*a* and a second lower body 10*b*. In this case, the plurality of intake holes 11 (refer to FIG. 3) may be formed on a side surface of the first lower body 10*a*. Moreover, the second lower body 10*b* may be disposed above the first lower body (10*a*). The lower body 10 may provide an inner space in which a filter 3, a control unit 4, and a fan 40** to be described later are disposed.

The filter 3 may be detachably installed in the inner space of the first lower body **10*a*. The filter 3 may be formed in a cylindrical shape as a whole. That is, the filter 3 may include a hole (unsigned) formed through the filter 3 in the up-down direction. In this case, indoor air may be introduced into the interior of the first lower body 10*a* through the intake hole 11 by the operation of the fan 40 to be described later. Moreover, the indoor air introduced into the first lower body 10*a* flows from an outer peripheral surface of the filter 3** to an inner peripheral surface thereof and is purified, and can flow upward through the hole.

The control unit 4 may be installed in the inner space of the first lower body 10*a*. For example, the control unit 4 may be disposed between the base 2 and the filter 3. The control unit 4 may control the operation of the blower 1. Meanwhile, the air flow passing through the filter 3 described above may be used to cool the control unit 4 having a heating element.

The fan 40 may cause an air flow to be introduced into the inside of the blower 1 or discharged to the outside from the blower 1. The fan 40 may be installed in the inner space of the second lower body 10*b*. The fan 40 may be disposed above the filter 3. The fan 40 may include a fan housing 41, a fan motor 42, a hub 43, a shroud 44, and a blade 45. Meanwhile, the fan 40 may be referred to as a fan module.

The fan housing 41 may form an exterior of the fan 40. The fan housing 41 may include a hole formed to penetrate the fan housing 41 in the up-down direction. A suction port 41*a* may be formed at a lower end of the fan housing 41. In this case, the suction port 41*a* may be a bell mouth.

The fan motor 42 may provide a rotational force. The fan motor 42 may be a centrifugal fan or a quadruple fan motor. The fan motor 42 may be supported by a motor cover 52 to be described later. In this case, a rotation shaft (unsigned) of the fan motor 42 may extend downward from the fan motor 42 and penetrate the lower surface of the motor cover 52. The hub 43 is coupled to the rotation shaft, and may be rotated together with the rotation shaft. The shroud 44 may be spaced apart from the hub 43. A plurality of blades 45 may be disposed between the shroud 44 and the hub 43.

Accordingly, when the fan motor 42 is driven, air may be introduced in an axial direction (that is, a longitudinal direction of the rotation shaft) of the fan motor 42 through the suction port 41*a*, and discharged in a radial direction (that is, a radial direction of the hub 43) and to an upper side thereof.

Meanwhile, an air guide 50 may provide a flow path 50*p* through which the air discharged from the fan 40 flows. For example, the flow path 50*p* may be an annular flow path. The air guide 50 may include a guide body 51, the motor cover 52, and a vane 53.

The guide body 51 may form an exterior of the air guide 50. The motor cover 52 may be disposed in a central portion of the air guide 50. For example, the guide body 51 may be formed in a cylindrical shape. In addition, the motor cover 52 may be formed in a bowl shape. In this case, the above-described annular flow path 50*p* may be formed between the guide body 51 and the motor cover 52. The vane 53 may guide the air provided from the fan 40 to the flow path 50*p* upward. A plurality of vanes 53 may be disposed on the annular flow path 50*p* and may be spaced apart from each other in the circumferential direction of the guide body 51. In this case, each of the plurality of vanes 53 may extend from an outer surface of the motor cover 52 to an inner circumferential surface of the guide body 51.

Meanwhile, the upper body 30 (refer to FIG. 3) may provide a first flow path 30*p* through which the air passing through the air guide 50 flows. That is, the air that has passed through the air guide 50 may be raised in the first flow path 30*p*. In addition, the side body 20 may provide a second flow path 20*p* through which the air passing through the first flow path 30*p* flows. That is, the air that has passed through the first flow path 30*p* may be raised in the second flow path 20*p*.

Figure 6:
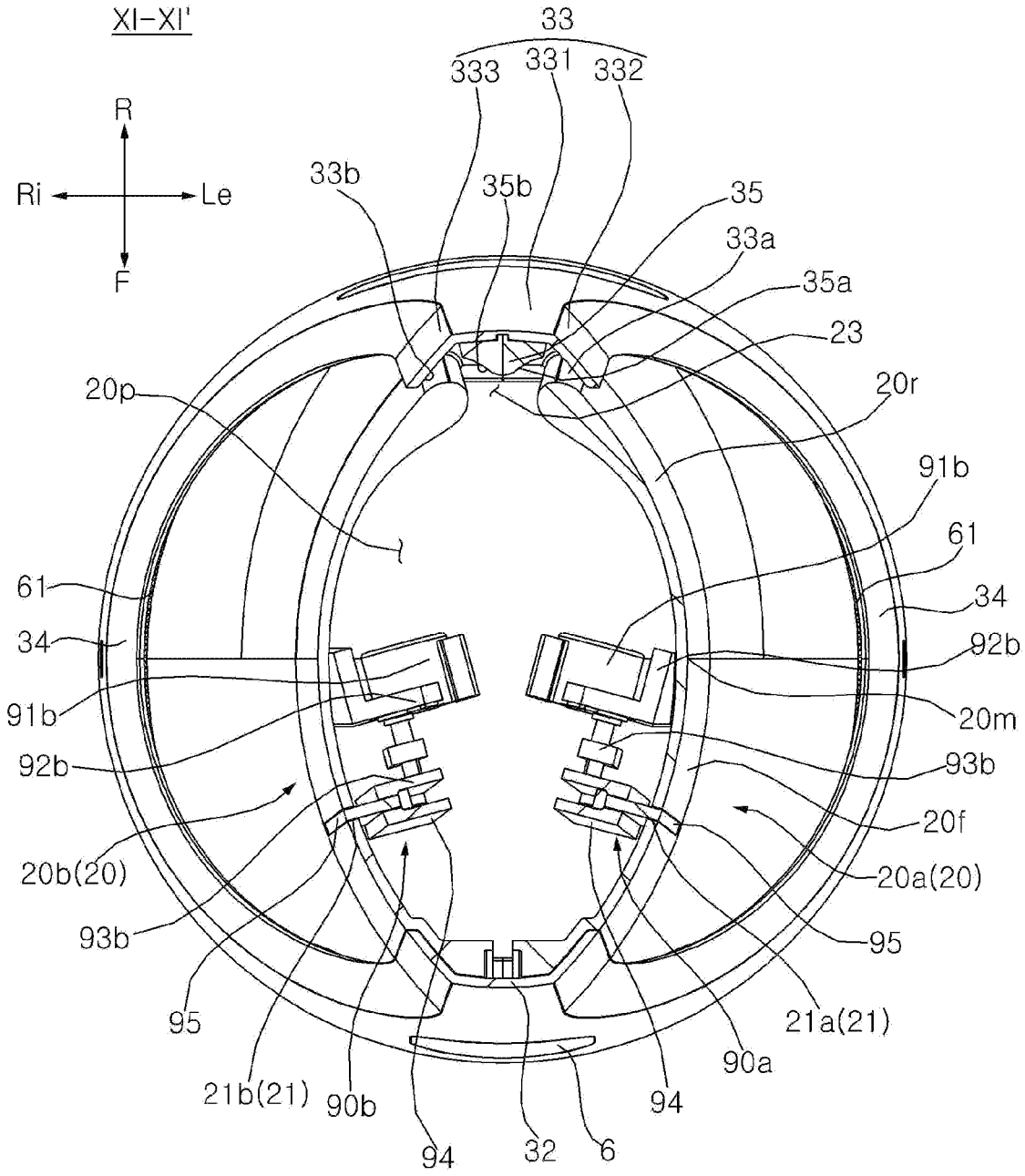
FIG. 6 is a cross-sectional view taken along line X1-X1' of FIG. 3 for explaining a first position of the damper.

Referring to FIGS. 4 and 6, the side body 20 may be divided into a rear portion 20*r*, a front portion 20*f*, and a central portion 20*m* in the front-rear direction. The rear portion 20*r* may extend forward while forming the rear end of the side body 20. In this case, a width of the rear portion 20*r* in the right-left direction may increase toward the front. The front portion 20*f* may extend rearwardly while forming the front end of the side body 20. In this case, a width of the front portion 20*f* in the right-left direction may increase toward the rear. The central portion 20*m* may be located between the rear portion 20*r* and the front portion 20*f*. In this case, the central portion 20*m* may be connected or coupled to the front end of the rear portion 20*r* and the rear end of the front portion 20*f*. In other words, a width of the central portion 20*m* in the right-left direction may be a maximum width of the side body 20. Meanwhile, the central portion 20*m* may be located at the center of the side body 20 in the front-rear direction, at the front of the center, or at the rear of the center.

For example, the slit 21 may be formed to be elongated in the up-down direction in the front portion 20*f*. In this case, the damper 90 to be described later is spaced apart forward from the front end of the rear portion 20*r* or the central portion 20*m* to open or close the slit 21, which will be described later in more detail.

For example, the side body 20 may include a first side body 20*a* and a second side body 20*b* coupled to each other. In this case, the first side body 20*a* may form the left surface of the side body 20, and the second side body 20*b* may form a right surface of the side body 20. In addition, the shape of the first side body 20*a* and the shape of the second side body 20*b* may be symmetrical in the right-left direction. In this case, the above-described rear portion 20*r*, front portion 20*f*, and central portion 20*m* may be formed on each of the first side body 20*a* and the second side body 20*b*.

In addition, the inner surface of the side body 20 may form a boundary of the above-described second flow path 20*p*. In addition, an opening 23 may be formed at the rear end of the side body 20 and communicate with the second flow path 20*p*. Specifically, the opening 23 may be formed between the rear end of the rear portion 20*r* of the first side body 20*a* and the rear end of the rear portion 20*r* of the second side body 20*b*, and elongated in the up-down direction. Accordingly, the air flowing through the second flow path 20*p* of the side body 20 may be discharged to the rear of the side body 20 through the opening 23.

The vanes 22 may be coupled to the inner surface of the side body 20. The vane 22 may guide the air rising from the second flow path 20*p* to the opening 23. The vane 22 may have an upward convex shape. The vane 22 may include a plurality of vanes 22*a*, 22*b*, 22*c*, and 22*d* spaced apart from each other in the up-down direction. In this case, lengths of the plurality of vanes 22*a*, 22*b*, 22*c*, and 22*d* may be different from each other. For example, a length of a vane located at an upper side of the plurality of vanes 22*a*, 22*b*, 22*c*, and 22*d* may be greater than a length of the vane located at a lower side. Each of the plurality of vanes 22*a*, 22*b*, 22*c*, and 22*d* may be spaced apart from the opening 23. For example, the plurality of vanes 22*a*, 22*b*, 22*c*, and 22*d* may be spaced apart from the opening 23 by the same gap.

The rear body 33 may be spaced rearwardly from the opening 23. The rear body 33 may guide the air discharged from the opening 23 to the outer surface of the side body 20. The rear body 33 may include a rear plate 331, a first rear guide 332, and a second rear guide 333.

The rear plate 331 may be located behind the opening 23. The rear plate 331 may extend long in the up-down direction.

The first rear guide 332 may extend obliquely to the left and forward from the left end of the rear plate 331. The first rear guide 332 is spaced apart from the rear portion 20*r* of the first side body 20*a*, and a first discharge port 33*a* may be formed between the first rear guide 332 and the rear portion 20*r* of the first side body 20*a* to discharge air. In this case, the first discharge port 33*a* may be formed to be elongated in the up-down direction. For example, the upper end of the first discharge port 33*a* may be located above the upper end of a first slit 21*a* to be described later, and the lower end of the first discharge port 33*a* may be located below the lower end of the first slit 21*a* to be described later.

In addition, a gap between the first rear guide 332 and the rear portion 20*r* of the first side body 20*a* may become smaller toward the front. That is, a tapered area may be formed between the first rear guide 332 and the rear portion 20*r* of the first side body 20*a*.

The second rear guide 333 may extend obliquely to the right and forward from the right end of the rear plate 331. The second rear guide 333 may be spaced apart from the rear portion 20*r* of the second side body 20*b*, and a second discharge port 33*b* is formed between the second rear guide 333 and the rear portion 20*r* of the second side body 20*b* to discharge air. In this case, the second discharge port 33*b* may be formed to be elongated in the up-down direction. For example, the upper end of the second discharge port 33*b* may be located above the upper end of the second slit 21*b* to be described later, and the lower end of the second discharge port 33*b* may be located below the lower end of the second slit 21*b* to be described later.

In addition, a gap between the second rear guide 333 and the rear portion 20*r* of the second side body 20*b* may become smaller toward the front. That is, a tapered area may be formed between the second rear guide 333 and the rear portion 20*r* of the second side body 20*b*. Meanwhile, the gap between the first rear guide 332 and the second rear guide 333 in the right-left direction may increase toward the front.

Accordingly, the air that has passed through the opening 23 is discharged from each of the first discharge port 33*a* and the second discharge port 33*b*, and may flow forward along the outer surface of each of the first side body 20*a* and the second side body 20*b*.

A splinter 35 may be disposed between the opening 23 and the rear plate 331 of the rear body 33. The splinter 35 may be spaced apart from the rear end of the side body 20 while being located at the rear of the opening 23. In addition, the splinter 35 may be coupled to the front surface of the rear plate 331.

A first inclined surface 35*a* of the splinter 35 may be the surface facing the rear end of the rear portion 20*r* of the first side body 20*a*, and the second inclined surface 35*b* may be a surface facing the rear end of the rear portion 20*r* of the side body 20*b*. The first inclined surface 35*a* and the second inclined surface 35*b* may be formed to be inclined with respect to the front surface of the rear plate 331. The first inclined surface 35*a* may extend obliquely to the left and rearward, and the second inclined surface 35*b* may extend obliquely to the right and rearward. That is, the gap between the first inclined surface 35*a* and the second inclined surface 35*b* in the right-left direction may increase toward the rear.

Accordingly, the splinter 35 may separate the air discharged from the opening 23 to the rear plate 331 of the rear body 33 in the right-left direction, and guide the separated air to the first discharge port 33*a* and the second discharge port 33*b*.

Figure 5:
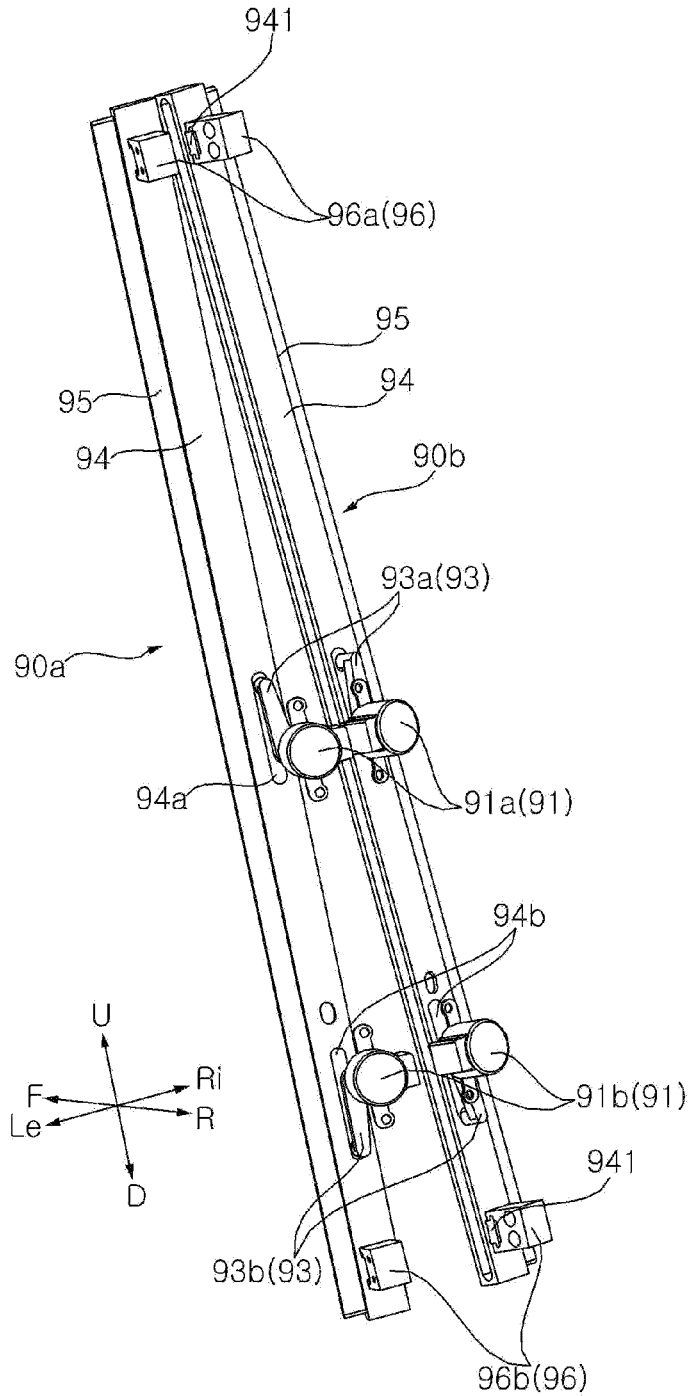
FIG. 5 is a perspective view of a damper according to one embodiment of the present disclosure.

Referring FIGS. 5 and 6, the damper 90 may be installed in the inner space of the side body 20. The damper 90 may open or close the slit 21 formed on the side surface of the side body 20. Here, the slit 21 may be formed to pass through the side surface of the side body 20 to communicate with the second flow path 20*p*, and to be elongated in the up-down direction. In addition, the damper 90 may include a motor 91, a bracket 92, a link 93, a body 94, a plate 95, and a damper guide 96.

The motor 91 may provide a rotational force. The motor 91 may be an electric motor. The motor 91 may control a rotation direction, a rotation angle, and a rotation speed of a rotation shaft of the motor 91. The motor 91 may be fixed to the inner surface of the side body 20 through the bracket 92 (refer to FIG. 4). For example, the motor 91 may include an upper motor 91*a* which is located on the relatively upper side and fixed to the side body 20 through an upper bracket 92*a*, and a lower motor 91*b* which is located on the relatively lower side and fixed to the side body 20 through a lower bracket 92*b*.

The link 93 may be connected to the rotation shaft of the motor 91. The link 93 is rotated or pivoted about the rotation shaft of the motor 91, and may move the body 94 and the plate 95 to be described later. For example, the link 93 may include an upper link 93*a* coupled to a rotation shaft of the upper motor 91*a* and a lower link 93*b* coupled to a rotation shaft of the lower motor 91*b*. In this case, a pivot direction of the upper link (93*a*) and a pivot direction of the lower link (93*b*) may be different or opposite to each other.

The body 94 may be elongated. The link holes 94*a* and 94*b* are provided in the body 94 and may be formed to be elongated in the longitudinal direction of the body 94. That is, the link holes 94*a* and 94*b* may be straight oblong holes. An end of the link 93 is inserted into the link holes 94*a* and 94*b*, and when the motor 91 is driven, the end may move along the link holes 94*a* and 94*b*. For example, the link holes 94*a* and 94*b* include an upper link hole 94*a* into which the end of the upper link 93*a* is movably inserted, and a lower link hole 94*b* into which the end of the lower link 93*b* is movably inserted. Meanwhile, the body 94 may be referred to as a connector.

The plate 95 is fixed to the body 94 and can move together with the body 94. The plate 95 may be inserted into the slit 21, or separated or detached from the slit 21. The plate 95 may have the same cross-section as the shape of the slit 21.

Meanwhile, a part of the plate 95 may be covered by the body 94. That is, the body 94 may provide an inner space into which a part of the plate 95 is inserted. For example, a light emitting element such as an LED or LED lamp may be disposed in the inner space of the body 94. In this case, by controlling whether the light emitting element operates according to the position of the plate 95, information on the position of the plate 95 may be provided to the user. To this end, the plate 95 may be formed of a transparent material to provide the light generated by the light emitting element to the outside.

The damper guide 96 may guide the movement of the body 94 and the plate 95. The damper guide 96 may guide the movements of the body 94 and the plate 95 in a direction perpendicular to or crossing the longitudinal direction of the link holes 94*a* and 94*b*. For example, a protrusion 941 may protrude from the body 94 and may be linearly movably coupled to the damper guide 96. In this case, the protrusion 941 may extend in a direction perpendicular to the longitudinal direction of the link holes 94*a* and 94*b*. For example, the damper guide 96 may include an upper guide 96*a* disposed above the body 94 and a lower guide 96*b* disposed below the body 94.

Accordingly, power of the motor 91 is transmitted to the body 94 through the link 93, and the body 94 and the plate 95 may move in a direction close to the slit 21 or a direction away from the slit 21 by the damper guide 96.

In addition, in a first state of the damper 90, an end of the upper link 93*a* may be located at an upper end of the upper link hole 94*a*, an end of the lower link 93*b* may be located at the lower end of the lower link hole 94*b* (refer to FIG. 5). Moreover, in the first state, the plate 95 may not be inserted into the slit 21 and may be located in the inner space of the side body 20. In this case, when the motor 91 is driven so that the plate 95 is inserted into the slit 21, the damper 90 is changed from the first state, so that the end of the upper link 93*a* may move downward along the upper link hole 94*a* and the end of the lower link 93*b* may move upward along the lower link hole 94*b*. In this case, since the damper guide 96 limits the moving direction of the protrusion 941 provided in the body 94 to a direction toward the slit 21, it is possible to prevent the body 94 from sagging in the direction of gravity during the movement of the above-described body 94.

For example, the slit 21 may be formed on either the left surface or the right surface of the side body 20. In this case, one damper 90 may be provided, and the plate 95 of the damper 90 may open or close the slit 21.

As another example, the slit 21 may include a first slit 21*a* formed on a left surface of the side body 20 and a second slit 21*b* formed on a right surface of the side body 20. In addition, the above-described damper 90 may include a first damper 90*a* adjacent to the first side body 20*a* and a second damper 90*b* adjacent to the second side body 20*b*. In this case, the plate 95 of the first damper 90*a* may open or close the first slit 21*a*, and the plate 95 of the second damper 90*b* may open or close the second slit 21*b*. Meanwhile, the first slit 21*a* and the second slit 21*b* may be symmetrical to each other in the right-left direction.

Accordingly, when the plate 95 opens the slit 21, the air flowing through the second flow path 20*p* may be discharged to the outside through the slit 21. Conversely, when the plate 95 closes the slit 21, the air flowing through the second flow path 20*p* may not pass through the slit 21.

Figure 7A:
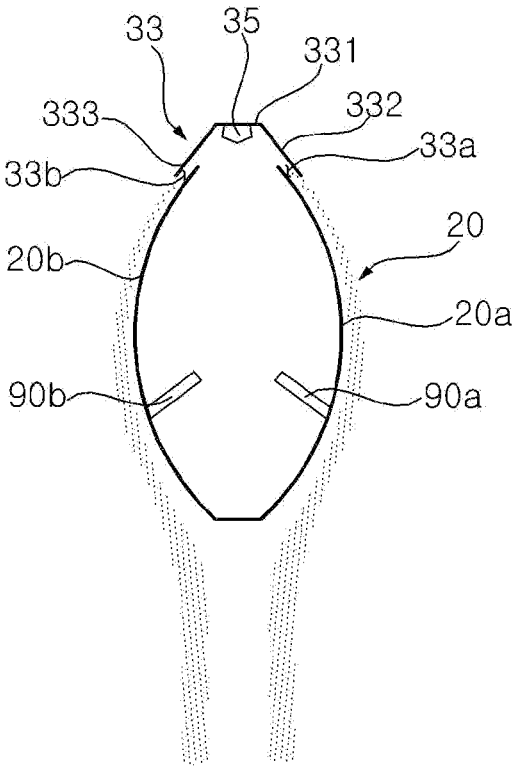
FIGS. 7A and 7B are views for explaining an air flow formed by the blower at the first position of the damper.
Figure 7B:
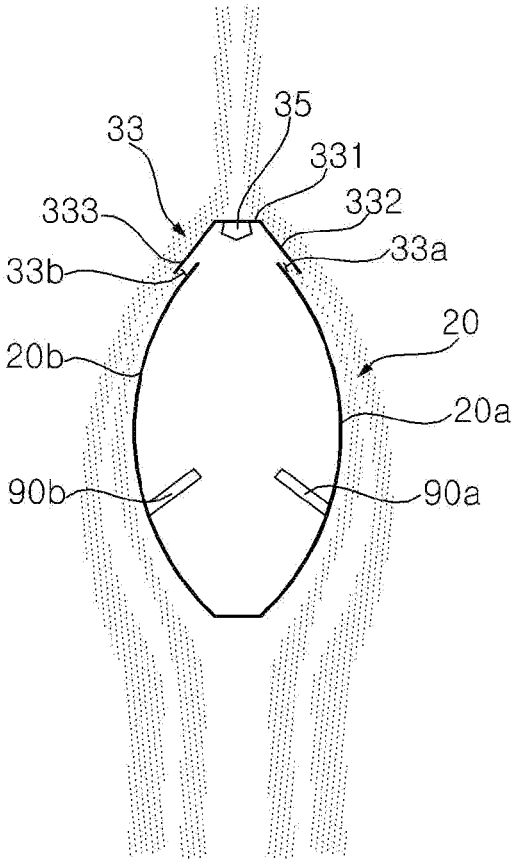

Referring to FIGS. 6 and 7, in the first position or the first state of the first damper 90*a* and the second damper 90*b*, the plate 95 of the first damper 90*a* may be inserted into the first slit 21*a* to close the first slit 21*a*, and the plate 95 of the second damper 90*b* may be inserted into the second slit 21*b* to close the second slit 21*b*.

The left surface of the plate 95 of the first damper 90*a* may be disposed parallel to the outer surface of the first side body 20*a*. That is, the left surface may have the same curvature as the outer surface of the first side body 20*a*, and the left surface may be smoothly connected to the outer surface of the first side body 20*a*. In other words, a step may not be formed between the left surface and the outer surface of the first side body 20*a*.

The right surface of the plate 95 of the second damper 90*b* may be disposed parallel to the outer surface of the second side body 20*b*. That is, the right surface may have the same curvature as the outer surface of the second side body 20*b*, and the right surface may be smoothly connected to the outer surface of the second side body 20*b*. In other words, a step may not be formed between the right surface and the outer surface of the second side body 20*b*.

Accordingly, when the fan motor 42 (refer to FIG. 4) is driven, air may be discharged from the first discharge port 33*a* and the second discharge port 33*b* to the outer surface of the side body 20. Moreover, due to the Coanda effect, the air discharged to the outer surface of the side body 20 may flow forward along the outer surface of the side body 20 (refer to (a) of FIG. 7). In addition, such an air flow may form an air flow in which the air around the side body 20 moves from the rear to the front (refer to (b) of FIG. 7). Meanwhile, such an air flow may be referred to as a concentrated air flow.

Figure 8:
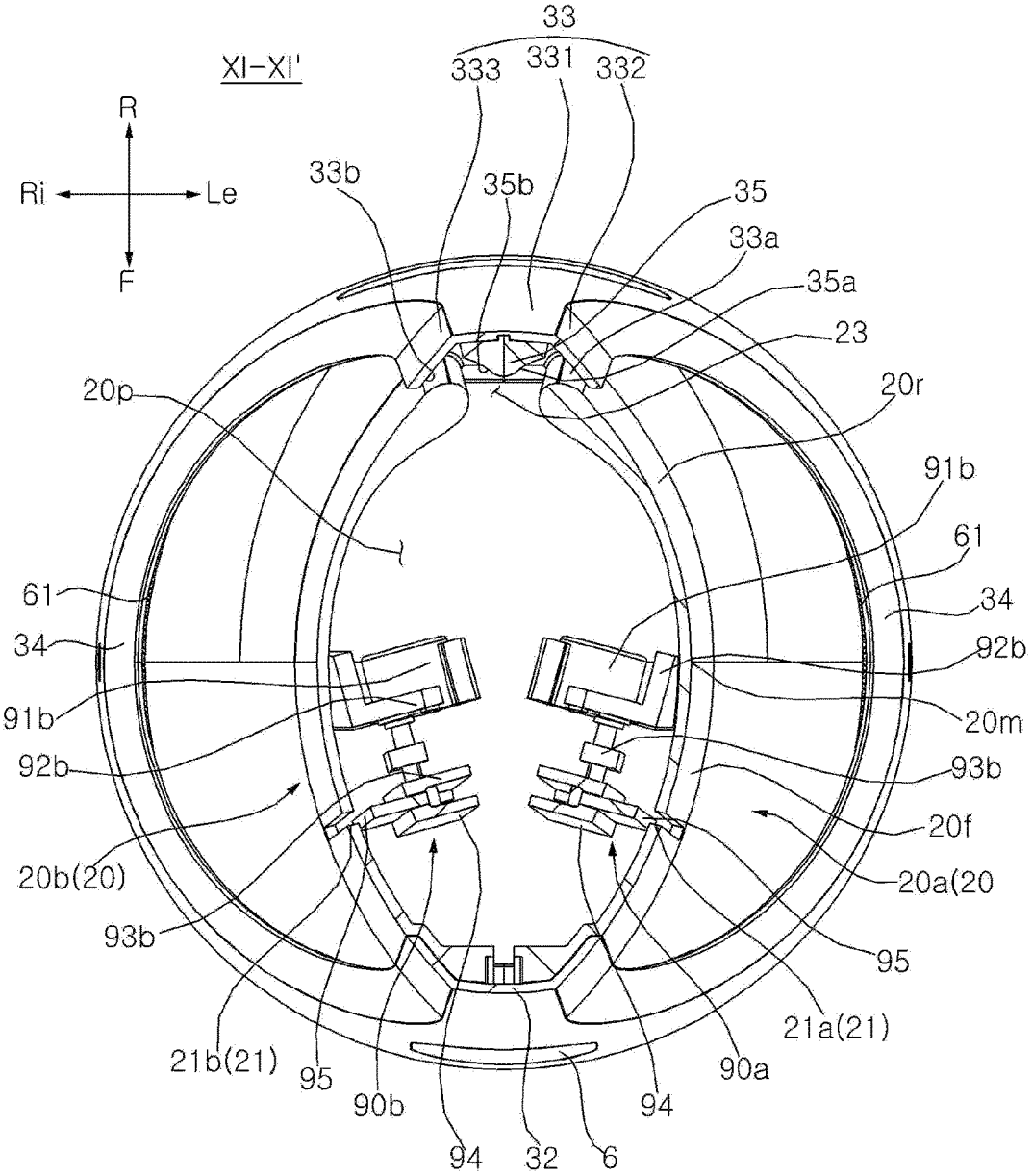
FIG. 8 is a cross-sectional view taken along line X1-X1' of FIG. 3 for explaining a second position of the damper.
Figure 9A:
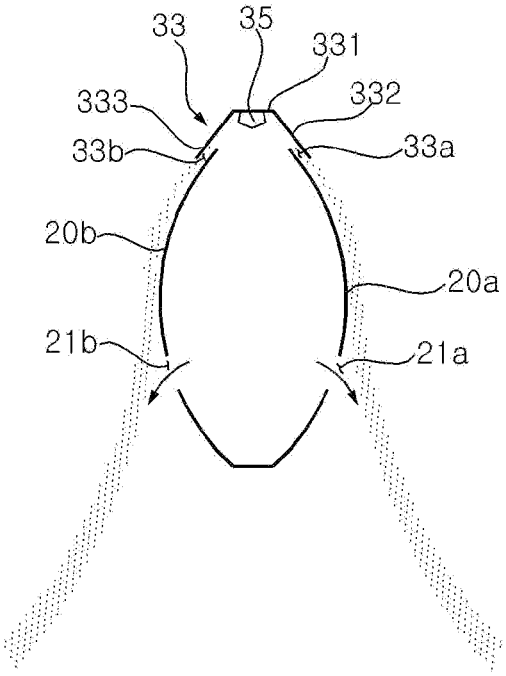
FIGS. 9A and 9B are views for explaining an air flow formed by the blower at the second position of the damper.
Figure 9B:
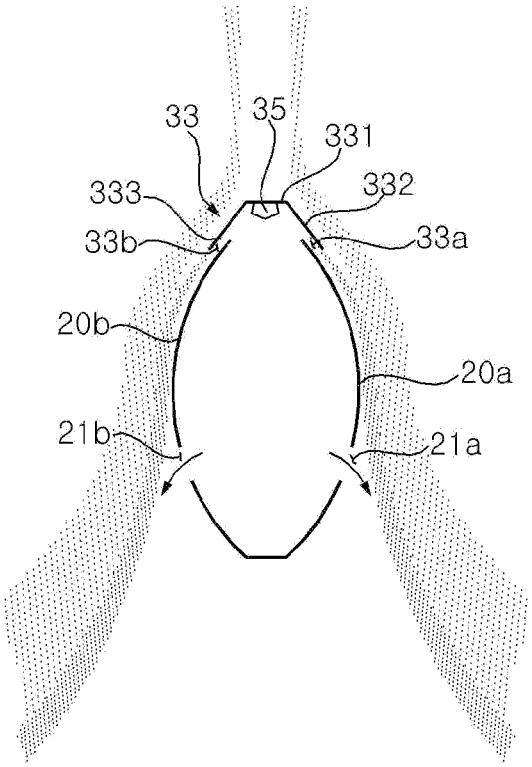

Referring to FIGS. 8 and 9, in the second positions or the second states of the first damper 90*a* and the second damper 90*b*, the plate 95 of the first damper 90*a* may not be inserted into the first slit 21*a* and may be disposed inside the side body 20 to open the first slit 21*a*, and the plate 95 of the second damper 90*b* may not be inserted into the second slit 21*b* and may be disposed inside the side body 20 to open the second slit 21*b*.

In this case, the second flow path 20*p* may communicate with the first slit 21*a* and the second slit 21*b*. That is, a part of the air passing through the second flow path 20*p* may be discharged to the outside through the first slit 21*a* and the second slit 21*b*.

Accordingly, when the fan motor 42 (refer to FIG. 4) is driven, the air discharged from the first discharge port 33*a* and the second discharge port 33*b* may flow forward along the outer surface of the side body 20, and may be dispersed in the right-left direction by the air discharged from the first slit 21*a* and the second slit 21*b* (refer to (a) of FIG. 9). In addition, such an air flow may form an air flow in which the air around the side body 20 is dispersed from the rear to the right-left direction and moved forward (refer to FIG. 9(*b*)). Meanwhile, such an air flow may be referred to as a first dispersed air flow.

Meanwhile, the plate 95 of the first damper 90*a* may not be inserted into the first slit 21*a* to open the first slit 21*a*, but the plate 95 of the second damper 90*b* may be inserted into the second slit 21*b* to close the second slit 21*b*. Alternatively, the plate 95 of the first damper 90*a* may be inserted into the first slit 21*a* to close the first slit 21*a*, but the plate 95 of the second damper 90*b* may not be inserted into the second slit 21*b* to open the second slit 21*b*. That is, any one of the first slit 21*a* and the second slit 21*b* may be open, but the other may be closed.

In this case, when the fan motor 42 (refer to FIG. 4) is driven, air may flow forward along the outer surface of the side body 20 and may spread to the left or right by the air discharged from by the air discharged from the open slit of the first slit 21*a* and the second slit 21*b*. Meanwhile, such an air flow may be referred to as a first deflection air flow.

Figure 10:
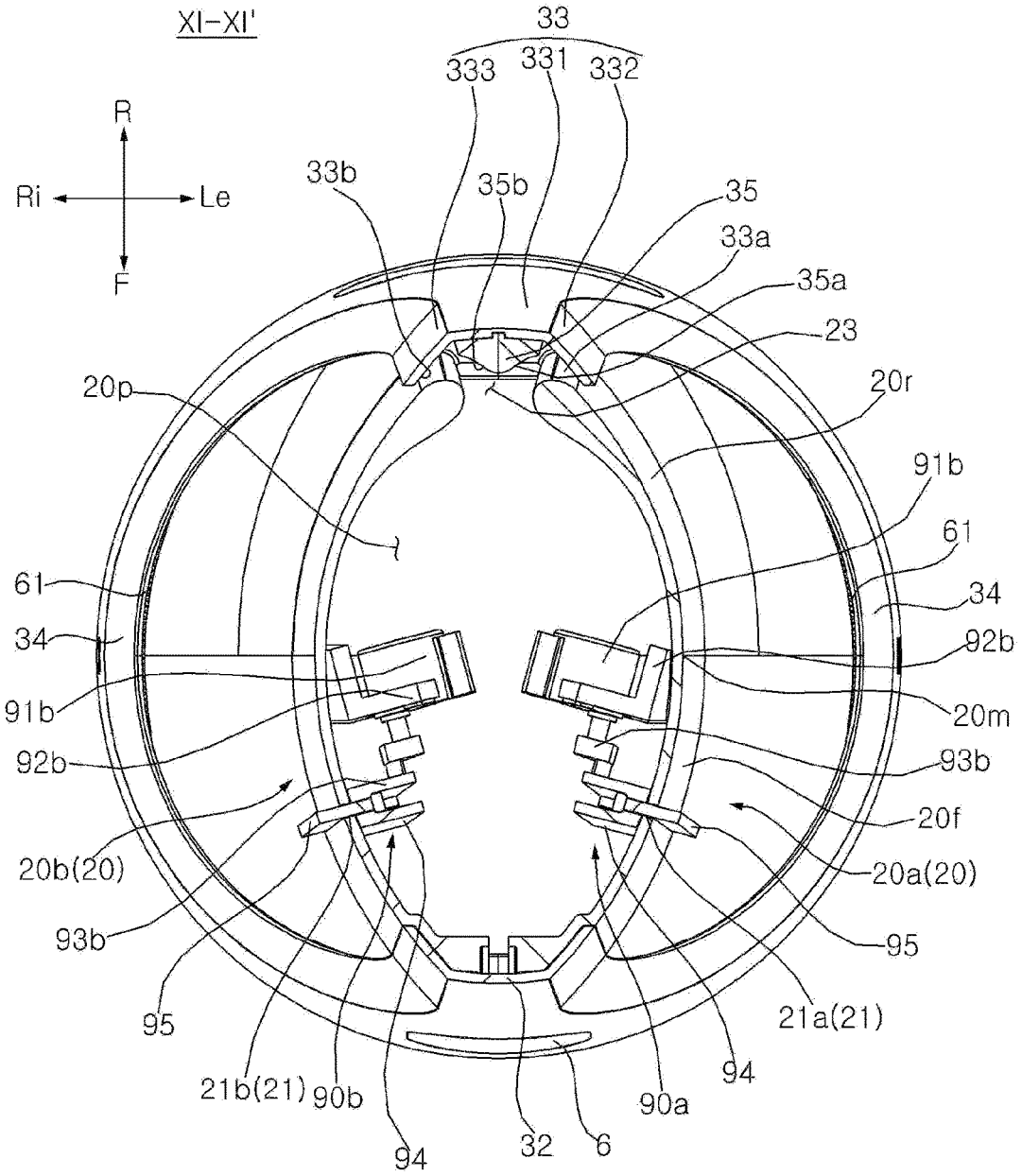
FIG. 10 is a cross-sectional view taken along line X1-X1' of FIG. 3 for explaining a third position of the damper.
Figure 11A:
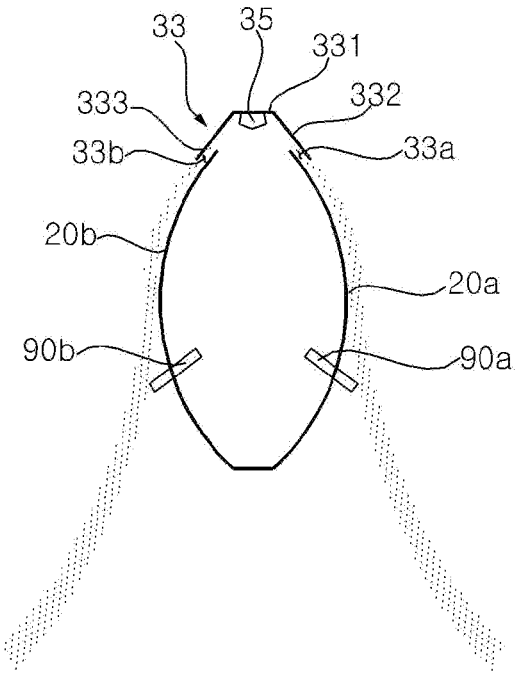
FIGS. 11A and 11B are views for explaining the air flow formed by the blower at the third position of the damper.
Figure 11B:
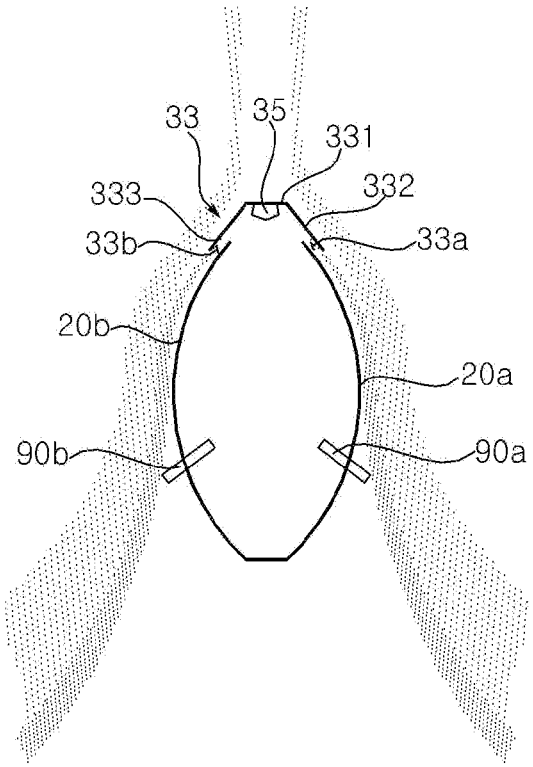

Referring to FIGS. 10 and 11, in third positions or in third states of the first damper 90*a* and the second damper 90*b*, the plate 95 of the first damper 90*a* may be inserted into the first slit 21*a* to close the first slit 21*a*, and the plate 95 of the second damper 90*b* may be inserted into the second slit 21*b* to close the second slit 21*b*.

A part of the plate 95 of the first damper 90*a* may protrude to the outside of the first side body 20*a*, and may be disposed to be stepped with respect to the first side body 20*a*. A part of the plate 95 of the second damper 90*b* may protrude to the outside of the second side body 20*b*, and may be disposed to be stepped with respect to the second side body 20*b*.

Accordingly, when the fan motor 42 (refer to FIG. 4) is driven, the air discharged from the first discharge port 33*a* and the second discharge port 33*b* may flow forward along the outer surface of the side body 20, and may be distributed in the right-left direction by the portion of the plate 95 protruding outward of the side body 20 (refer to (a) of FIG. 11). In addition, such an air flow may form an air flow in which the air around the side body 20 is dispersed in the right-left direction from the rear and moves forward (refer to (b) of FIG. 11). Meanwhile, such an air flow may be referred to as a second dispersed air flow.

Meanwhile, the plate 95 of the first damper 90*a* may be inserted into the first slit 21*a* to protrude to the outside of the first side body 20*a*, but the plate 95 of the second damper 90*b* may be inserted into the second slit 21*b* to be disposed in parallel to the outer surface of the second side body 20*b*. Alternatively, the plate 95 of the first damper 90*a* may be inserted into the first slit 21*a* to be disposed in parallel to the outer surface of the first side body 20*a*, but the plate 95 of the second damper 90*b* may be inserted into the first slit 21*a* to protrude to the outside of the second side body 20*b*. That is, both the first slit 21*a* and the second slit 21*b* are closed, and the plate 95 inserted into any one of them may protrude to the outside of the side body 20.

In this case, when the fan motor 42 (refer to FIG. 4) is driven, air may flow forward along the outer surface of the side body 20 and spread to the left or right by the plate 95 which is inserted into any one of the first slit 21*a* and the second slit 21*b* and protrudes to the outside of the side body 20. Meanwhile, such an air flow may be referred to as a second deflection air flow.

Figure 12:
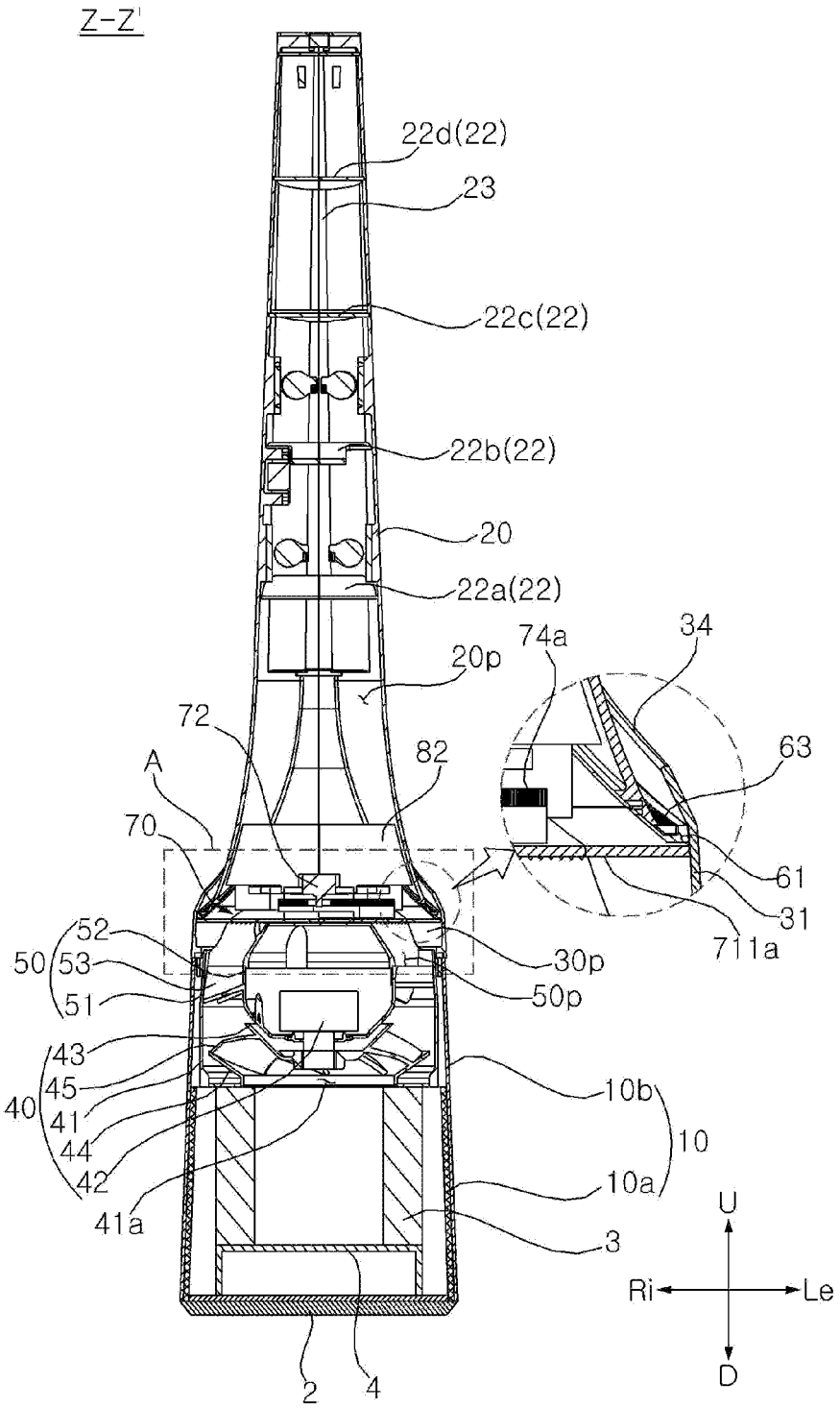
FIG. 12 is a cross-sectional view taken along line Z-Z' of FIG. 3.

Referring to FIG. 12, the hole 61 may be located between the left surface of the side body 20 and the inner surface of the middle body 31, and formed on at least one of the right surface of the side body 20 and the inner surface of the middle body 31. In this case, the hole 61 may be located below the opening 23 described above. A part of the air that has passed through the first flow path 30*p* described above may move upward through the hole 61. Meanwhile, the hole 61 may be referred to as a gap.

Meanwhile, a grill 63 has a plurality of holes (unsigned) and may be disposed between the side body 20 and a bending part 34 to be described later. That is, the grill 63 may have one end coupled to the side body 20 and the other end coupled to the bending part 34, and maintain a gap between the side body 20 and the bending part 34. For example, the grill 63 may be disposed above the above-described hole 61. For example, the grill 63 may have a shape corresponding to or identical to the shape of the hole 61.

The bending part 34 may be bent toward the side body 20 from a portion forming the boundary of the hole 61 of the middle body 31. In this case, the bending part 34 is disposed inclined with respect to the side body 20, and may be spaced apart from the side body 20. In addition, the gap between the side body 20 and the bending part 34 may become narrower toward the upper side. That is, a tapered area may be formed between the side body 20 and the bending part 34.

Accordingly, the air discharged from the hole 61 may flow upward along the outer surface of the side body 20 between the side body 20 and the bending part 34.

Figure 13:
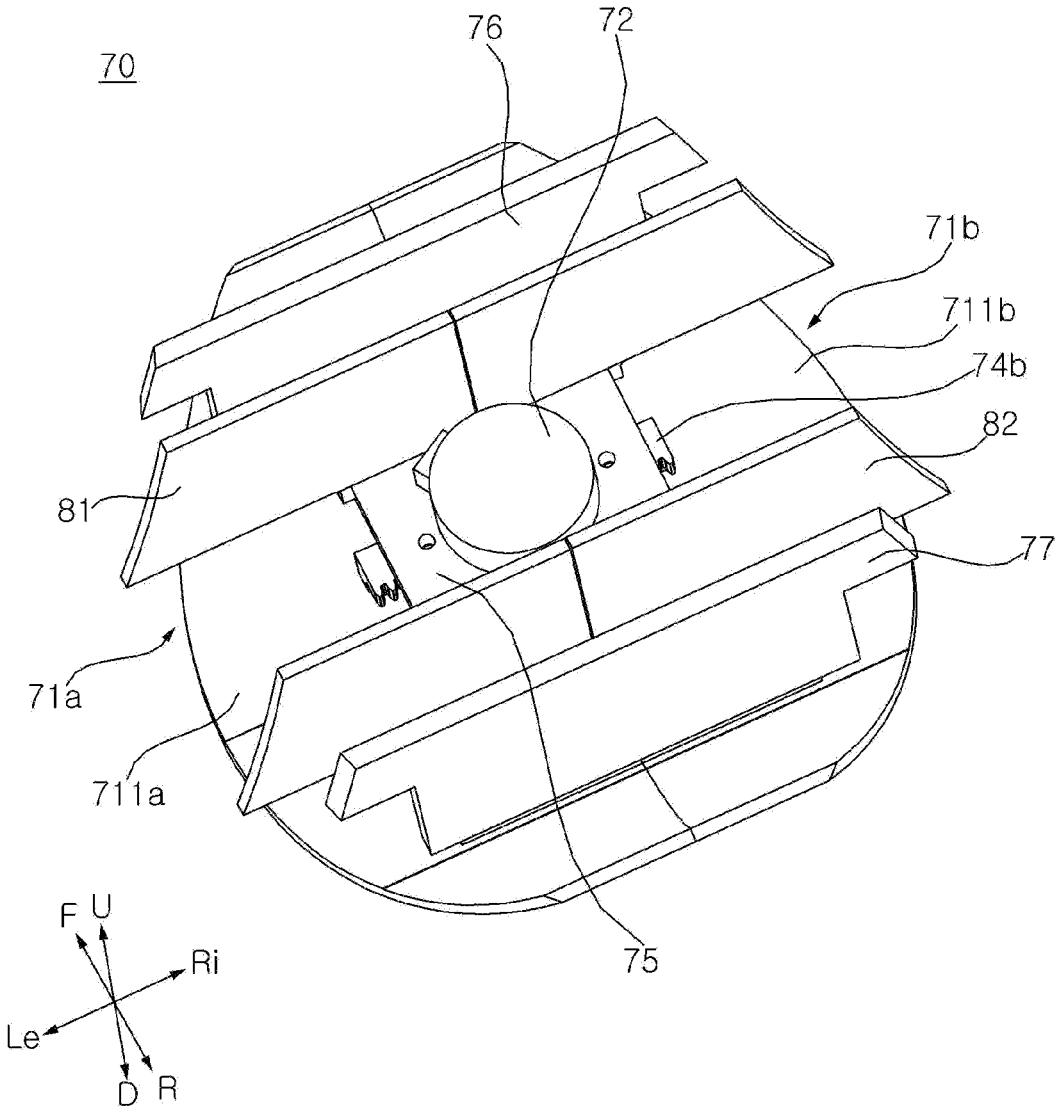
FIG. 13 is a perspective view of an inner damper according to one embodiment of the present disclosure.

Referring to FIGS. 12 and 13, the inner damper 70 may be installed in the inner space of the middle body 31. The inner damper 70 may be formed between the hole 61 formed between the left surface of the side body 20 and the inner surface of the middle body 31, and the hole 61 formed between the right surface of the side body 20 and the inner surface of the middle body 31.

The inner damper 70 may open or close the hole 61. Here, the opening of the hole 61 may mean a state in which a part of the air that has passed through the first flow path 30*p* can pass through the hole 61, and the closing of the hole 61 may mean a state in which the air that has passed through the first flow path 30*p* cannot pass through the hole 61.

Accordingly, the air that has passed through the first flow path 30*p* may be provided to the second flow path 20*p* by the inner damper 70 or may be provided to the second flow path 20*p* and the hole 61.

Figure 14:
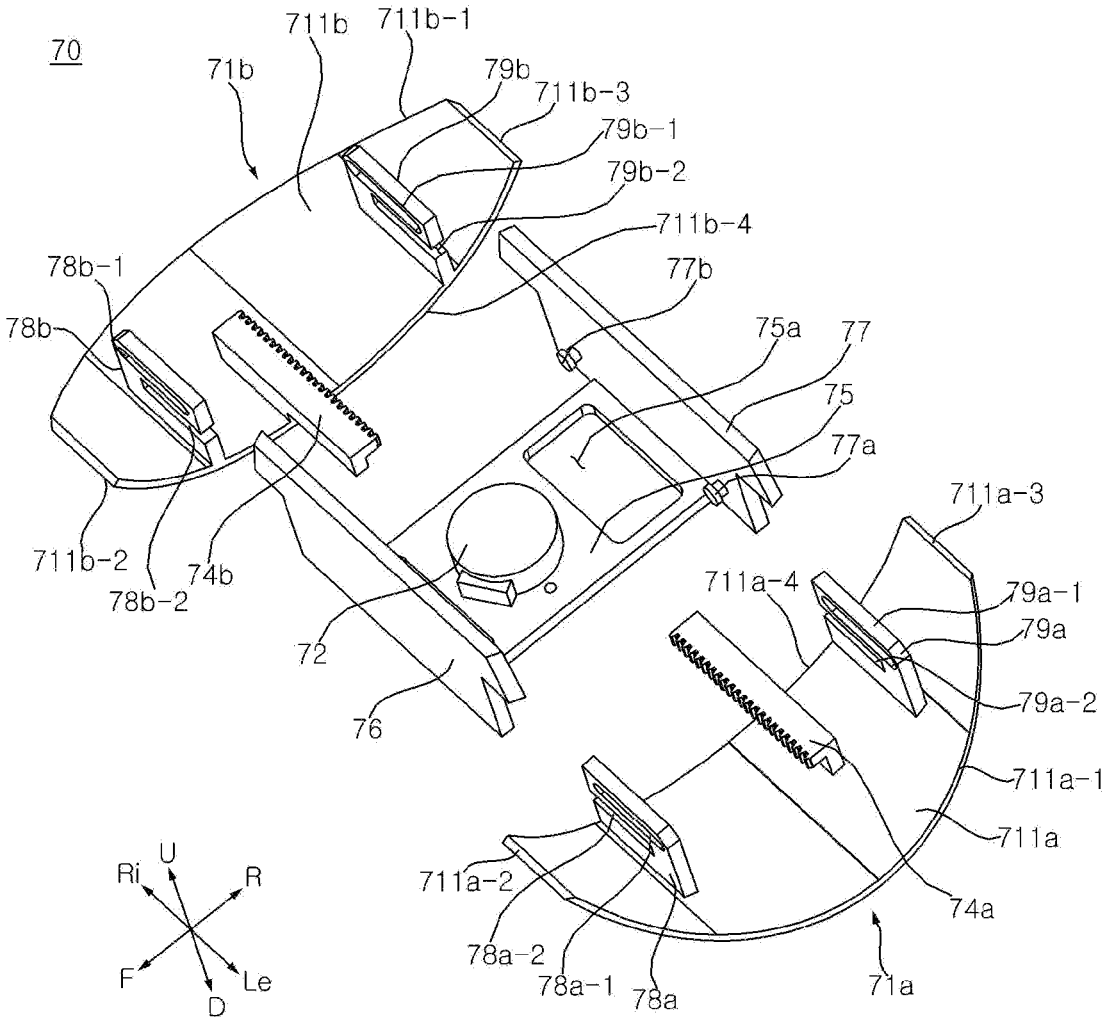
FIG. 14 is an exploded perspective view of the inner damper according to one embodiment of the present disclosure.

Referring FIGS. 13 and 14, the inner damper 70 may include a first cover assembly 71*a* and a second cover assembly 71*b* that are movable in the right-left direction. The first cover assembly 71*a* may move to the left and close the hole 61 (refer to FIG. 12) formed between the left surface of the side body 20 and the inner surface of the middle body 31. The second cover assembly 71*b* may move to the right and close the hole 61 (refer to FIG. 12) formed between the right surface of the side body 20 and the inner surface of the middle body 31. Meanwhile, when the hole 61 is formed only between the inner surface of the middle body 31 and any one of the left and right surfaces of the side body 20, the inner damper 70 may be provided in any one of the first cover assembly 71*a* and the second cover assembly 71*b*.

The motor 72 of the inner damper 70 may provide power for moving the first cover assembly 71*a* and the second cover assembly 71*b*. The motor 72 may be installed on a mount 75. In this case, the mount 75 may be a plate extending in a horizontal direction. A rotation shaft of the motor 72 may extend downwardly from the motor 72 and pass through the mount 75. A pinion 73 (refer to FIG. 15) may be coupled to the rotation shaft at the lower side of the mount 75 and rotate together with the rotation shaft.

Meanwhile, a mount hole 75*a* may be formed by penetrating the mount 75 in the up-down direction. The mount hole 75*a* may be spaced apart from the hole 61 in a moving direction of the first cover assembly 71*a* or the second cover assembly 71*b*. That is, the first cover assembly 71*a* or the second cover assembly 71*b* may close the mount hole 75*a* while opening the hole 61 or open the mount hole 75*a* while closing the hole 61, which will be described in more detail later.

A first supporter 76 may be provided at a front end of the mount 75 and may be extended in the up-down direction to be fixed to the side body 20 (refer to FIG. 12). In this case, a first left pin 76*a* (not illustrated) and a first right pin 76*b* (not illustrated) may protrude rearward from the inner surface of the first supporter 76 and may be spaced apart from each other in the right-left direction. The second supporter 77 may be provided at the rear end of the mount 75 and may be extended in the up-down direction to be fixed to the side body 20 (refer to FIG. 12). In this case, the second left pin 77*a* and the second right pin 77*b* may protrude forward from the inner surface of the second supporter 77 and may be spaced apart from each other in the right-left direction. Meanwhile, the above-described pins 76*a*, 76*b*, 77*a*, and 77*b* may be provided as rollers.

The first cover assembly 71*a* may include a first cover 711*a*, a first rack 74*a*, a first front rail 78*a*, and a first rear rail 79*a*.

The first cover 711*a* may be a plate extending in the horizontal direction. A shape of a left end 711*a*-1 of the first cover 711*a* may correspond to or be the same as the shape of the inner surface of the middle body 31 (refer to FIG. 12) facing the left end 711*a*-1 in the right-left direction. Accordingly, when the first cover 711*a* moves to the left and contacts the inner surface of the middle body 31, the first cover 711*a* may be disposed below a hole 6 (refer to FIG. 12) formed between the left surface of the side body 20 and the inner surface of the middle body 31 to close the hole 61.

In addition, a front end 711*a*-2 and a rear end 711*a*-3 of the first cover 711*a* may be spaced apart from the inner surface of the middle body 31. In addition, a shape of a right end 711*a*-4 of the first cover 711*a* may correspond to or be the same as a shape of a left end 711*b*-4 of the second cover 711*b* to be described later.

The first rack 74*a* may be coupled on the first cover 711*a* and extend long in the right-left direction. For example, a gear may be formed on a front surface of the first rack 74*a* and engaged with the above-described pinion 73 (refer to FIG. 15). Accordingly, when the pinion 73 rotates, the first rack 74*a* and the first cover 711*a* coupled thereto may move in the right-left direction.

The first front rail 78*a* may be installed on the first cover 711*a* and extend long in the right-left direction. The first front rail 78*a* may be adjacent to the front end 711*a*-2 of the first cover 711*a*. A first front slot 78*a*-1 may be formed to pass through the first front rail 78*a* in the front-rear direction, and may be formed to be elongated in the right-left direction, which is the longitudinal direction of the first front rail 78*a*. The first front hole 78*a*-2 is formed to be depressed from the right surface of the first front rail 78*a* to the left, and may be formed to be elongated in the right-left direction, which is a longitudinal direction of the first front rail 78*a*. In addition, the first front hole 78*a*-2 may be located below the first front slot 78*a*-1.

In this case, the above-described first left pin 76*a* (not illustrated) may be movably inserted into the first front slot 78*a*-1, and the mount 75 may be movably inserted into the first front hole 78*a*-2. That is, the relative moving directions of the first left pin 76*a* and the mount 75 with respect to each of the first front slot 78*a*-1 and the first front hole 78*a*-2 may be limited in the right-left direction. Accordingly, the first front rail 78*a* may limit the movement in the up-down direction while guiding the movement of the first cover 711*a* in the right-left direction.

The first rear rail 79*a* may be installed on the first cover 711*a* and extend long in the right-left direction. The first rear rail 79*a* may be adjacent to the rear end 711*a*-3 of the first cover 711*a*. The first rear slot 79*a*-1 may be formed to pass through the first rear rail 79*a* in the front-rear direction, and may be formed to be elongated in the right-left direction, which is a longitudinal direction of the first rear rail 79*a*. The first rear hole 79*a*-2 may be formed while being depressed from the right side of the first rear rail 79*a* to the left, and may be formed to be elongated in a right-left direction which is a longitudinal direction of the first rear rail 79*a*. In addition, the first rear hole 79*a*-2 may be located below the first rear slot 79*a*-1.

In this case, the above-described second left pin 77*a* may be movably inserted into the first rear slot 79*a*-1, and the mount 75 may be movably inserted into the first rear hole 79*a*-2. That is, the relative moving directions of the second left pin 77*a* and the mount 75 with respect to each of the first rear slot 79*a*-1 and the first rear hole 79*a*-2 may be limited in the right-left direction. Accordingly, the first rear rail 79*a* may limit the movement in the up-down direction while guiding the movement of the first cover 711*a* in the right-left direction.

Accordingly, when the motor 72 is driven, the first cover 711*a* may open or close the hole 61 (refer to FIG. 12) formed between the left surface of the side body 20 and the inner surface of the middle body 31 while moving stably in the right-left direction.

The second cover assembly 71*b* may include a second cover 711*b*, a second rack 74*b*, a second front rail 78*b*, and a second rear rail 79*b*.

The second cover 711*b* may be a plate extending in a horizontal direction. A shape of a right end 711*b*-1 of the second cover 711*b* may correspond to or be the same as the shape of the inner surface of the middle body 31 (refer to FIG. 12) facing the right end 711*b*-1 in the right-left direction. Accordingly, when the second cover 711*b* moves to the right and comes into contact with the inner surface of the middle body 31, the second cover 711*b* may be disposed below the hole 61 (refer to FIG. 12) formed between the right surface of the side body 20 and the inner surface of the middle body 31 to close the hole 61.

In addition, the front end 711*b*-2 and the rear end 711*b*-3 of the second cover 711*b* may be spaced apart from the inner surface of the middle body 31. In addition, a shape of a left end 711*b*-4 of the second cover 711*b* may correspond to or be the same as the shape of the right end 711*a*-4 of the first cover 711*a* described above.

The second rack 74*b* may be coupled on the second cover 711*b* and extend long in the right-left direction. For example, a gear may be formed on the rear surface of the second rack 74*b* and engaged with the above-described pinion 73 (refer to FIG. 15). Accordingly, when the pinion 73 rotates, the second rack 74*b* and the second cover 711*b* coupled thereto may move in the right-left direction. In addition, the pinion 73 may be disposed between the second rack 74*b* and the above-described first rack 74*a*. That is, the movements of the second rack 74*b* and the first rack 74*a* may not interfere with each other.

The second front rail 78*b* may be installed on the second cover 711*b* and extend in the right-left direction. The second front rail 78*b* may be adjacent to the front end 711*b*-2 of the second cover 711*b*. The second front slot 78*b*-1 may be formed to pass through the second front rail 78*b* in the front-rear direction, and may be formed to be elongated in the right-left direction which is a longitudinal direction of the second front rail 78*b*. The second front hole 78*b*-2 may be formed to be depressed from the left surface of the second front rail 78*b* to the right, and may be formed to be elongated in the right-left direction, which is a longitudinal direction of the second front rail 78*b*. In addition, the second front hole 78*b*-2 may be located below the second front slot 78*b*-1.

In this case, the above-described first right pin 76*b* (not illustrated) may be movably inserted into the second front slot 78*b*-1, and the mount 75 may be movably inserted into the second front hole 78*b*-2. That is, the relative moving directions of the first right pin 76*b* and the mount 75 with respect to each of the second front slot 78*b*-1 and the second front hole 78*b*-2 may be limited in the right-left direction. Accordingly, the second front rail 78*b* may limit the movement in the up-down direction while guiding the movement of the second cover 711*b* in the right-left direction.

The second rear rail 79*b* may be installed on the second cover 711*b* and extend long in the right-left direction. The second rear rail 79*b* may be adjacent to the rear end 711*b*-3 of the second cover 711*b*. The second rear slot 79*b*-1 may be formed to pass through the second rear rail 79*b* in the front-rear direction, and may be formed to be elongated in the right-left direction, which is a longitudinal direction of the second rear rail 79*b*. The second rear hole 79*b*-2 may be formed to be depressed from the left surface of the second rear rail 79*b* to the right, and may be formed to be elongated in the right-left direction, which is the longitudinal direction of the second rear rail 79*b*. In addition, the second rear hole 79*b*-2 may be located below the second rear slot 79*b*-1.

In this case, the above-described second right pin 77*b* may be movably inserted into the second rear slot 79*b*-1, and the mount 75 may be movably inserted into the second rear hole 79*b*-2. That is, the relative moving directions of the second right pin 77*b* and the mount 75 with respect to each of the second rear slot 79*b*-1 and the second rear hole 79*b*-2 may be limited in the right-left direction. Accordingly, the second rear rail 79*b* may limit the movement in the up-down direction while guiding the movement of the second cover 711*b* in the right-left direction.

Accordingly, when the motor 72 is driven, the second cover 711*b* may open or close the hole 61 (refer to FIG. 12) formed between the right surface of the side body 20 and the inner surface of the middle body 31 while moving stably in the right-left direction.

Meanwhile, the brackets 81 and 82 may fix the position of the mount 85 with respect to the side body 20 (refer to FIG. 4). The brackets 81 and 82 may be coupled to the mount 75 and the side body 20 between the mount 75 and the side body 20. The brackets 81 and 82 may be located between the first supporter 76 and the second supporter 77 in the front-rear direction. The brackets 81 and 82 may include a first bracket 81 adjacent to the first supporter 76 and a second bracket 82 adjacent to the second supporter 77.

Figure 15:
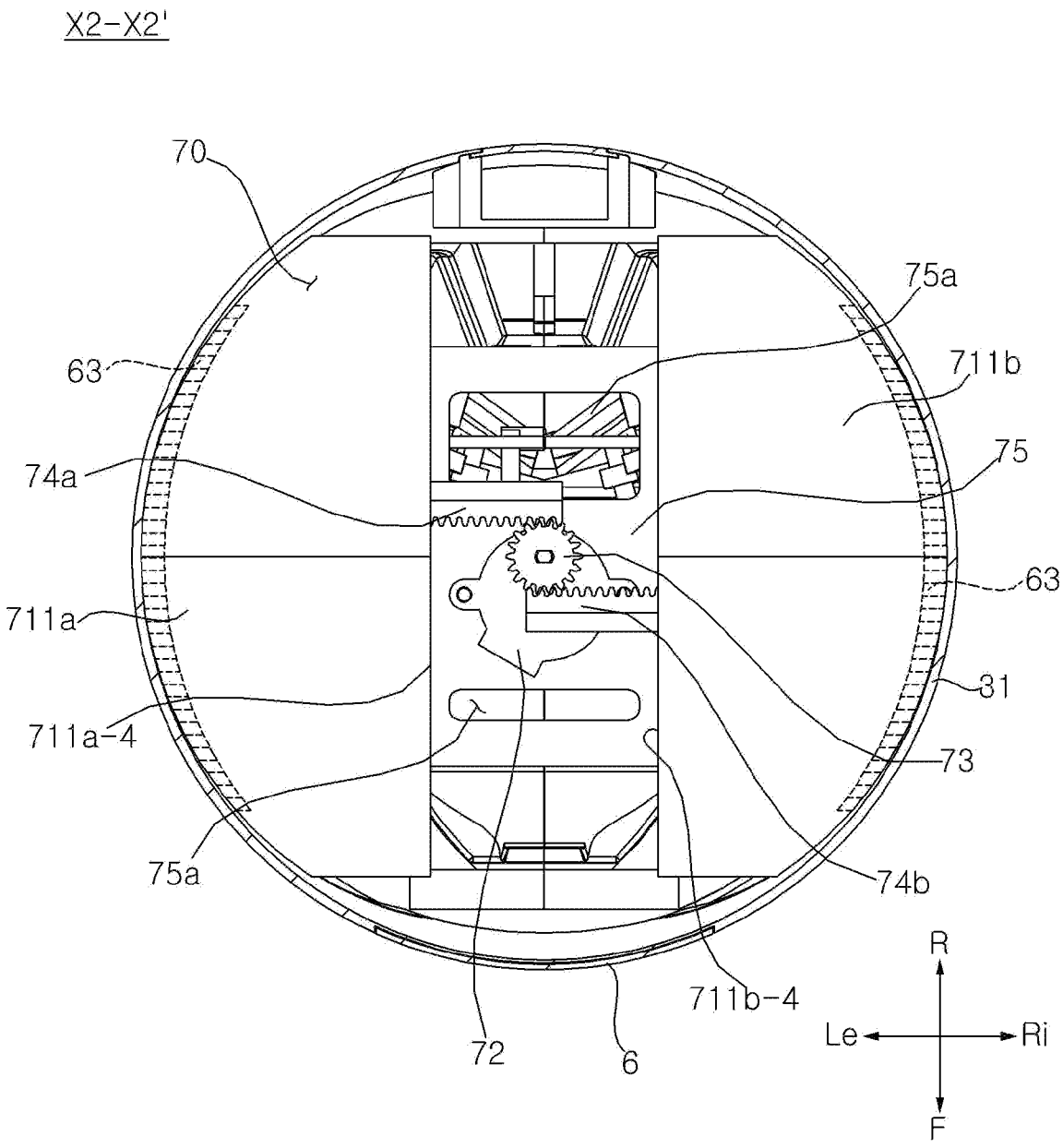
FIG. 15 is a cross-sectional view taken along line X2-X2' of FIG. 3 for explaining a first position of the inner damper.
Figure 16:
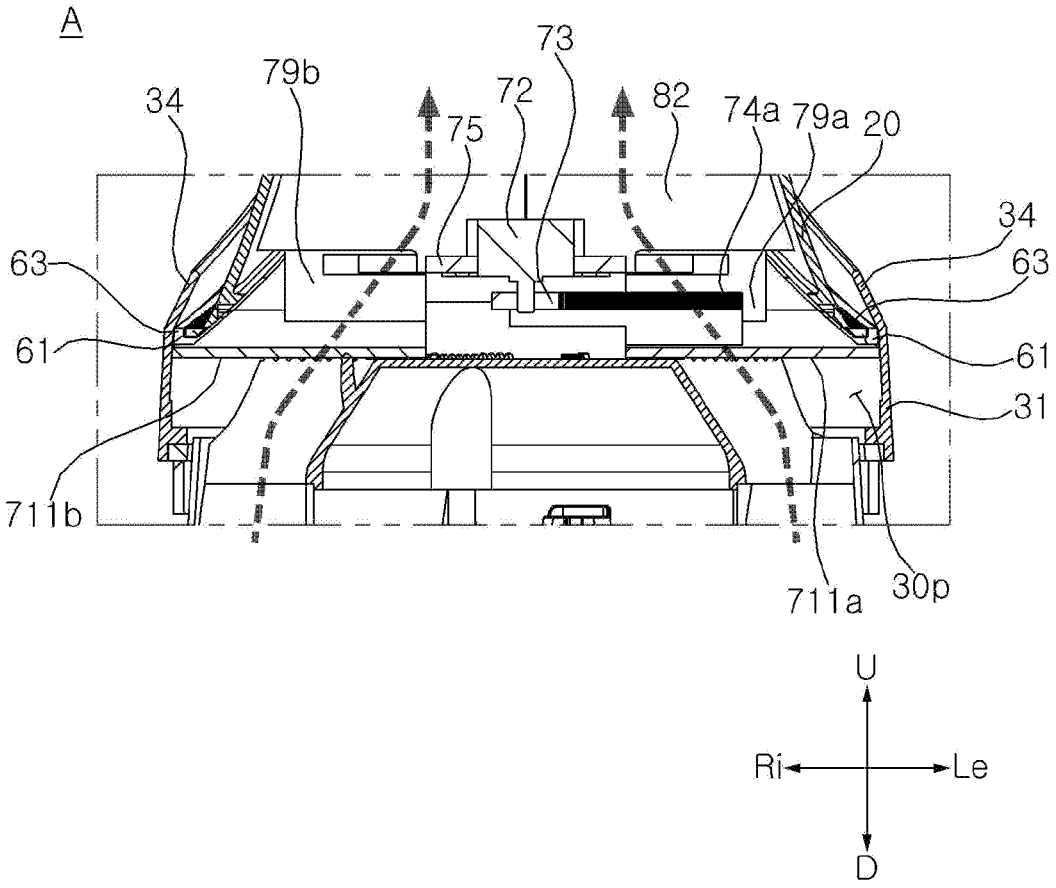
FIG. 16 is a view for explaining a flow path of air formed inside the blower at the first position of the inner damper and is an enlarged view of a part "A".

Referring to FIGS. 15 and 16, in the first position or first state of the inner damper 70, the first cover 711*a* may move to the left to come into contact with the inner surface of the middle body 31, and the second cover 711*b* may move to come into contact with the right to come into contact with the inner surface of the middle body 31.

In this case, the first cover 711*a* may be located below the grill 63 and may close the hole 61 (refer to FIG. 12) formed between the left surface of the side body 20 and the inner surface of the middle body 31. Moreover, the second cover 711*b* may be located below the grill 63, and may close the hole 61 (refer to FIG. 12) formed between the right side of the side body 20 and the inner surface of the middle body 31.

Accordingly, when the fan motor 42 (refer to FIG. 12) is driven, the air that has passed through the first flow path 30*p* may flow to the second flow path 20*p* (refer to FIG. 12) through the mount hole 75*a* formed in the mount 75 and the space formed inside the middle body 31 at the front and rear of the mount 75 (refer to an arrow indicated by a dotted line in FIG. 16).

Figure 17:
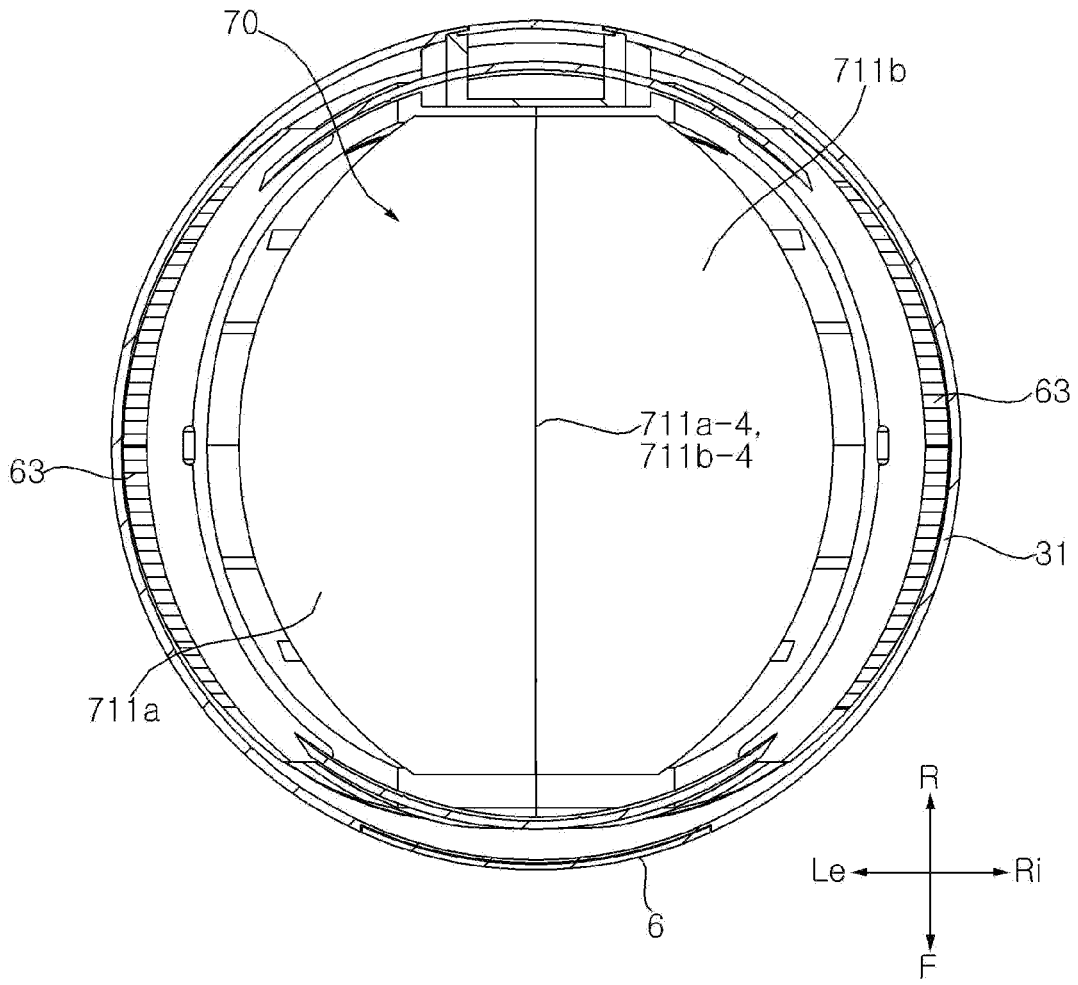
FIG. 17 is a cross-sectional view taken along line X2-X2' of FIG. 3 for explaining the second position of the inner damper.
Figure 18:
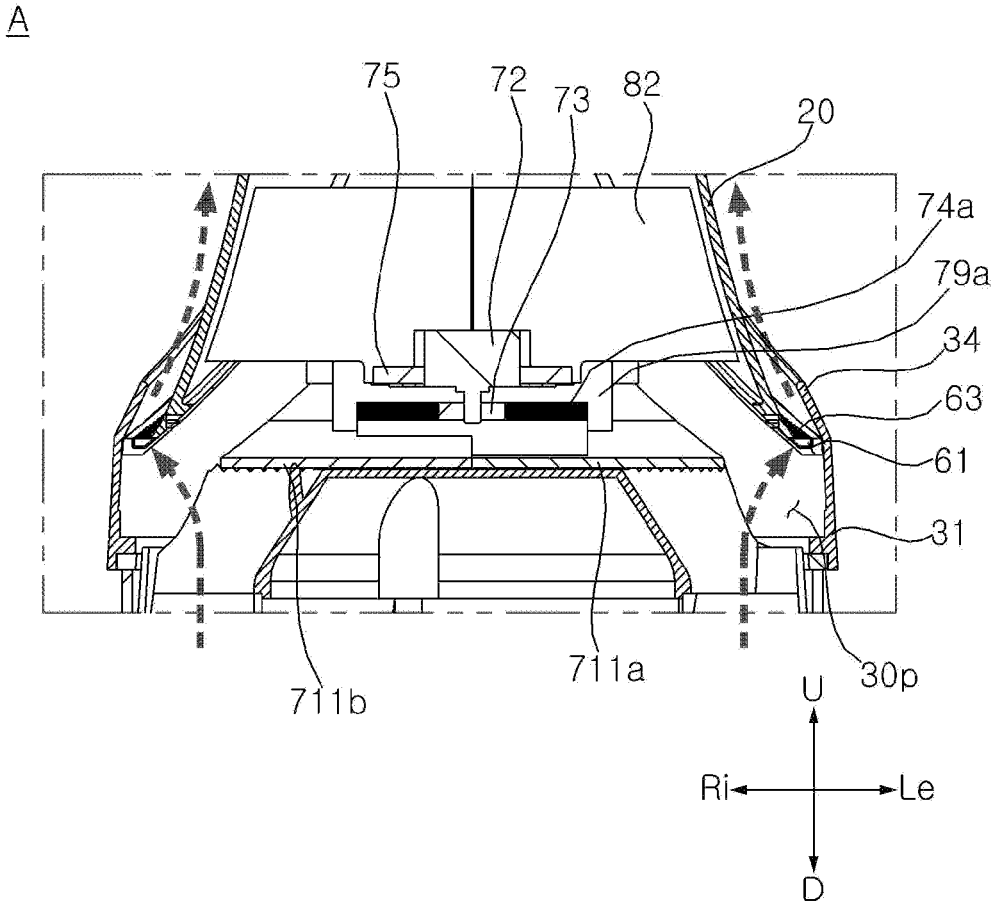
FIG. 18 is a view for explaining a flow path of air formed inside the blower at the second position of the inner damper and is an enlarged view of a part "A".

Referring FIGS. 17 and 18, in the second position or the second state of the inner damper 70, the first cover 711*a* may be moved to the right, the second cover 711*b* may be moved to the left, and the right end 711*a*-4 of the first cover 711*a* and the left end 711*b*-4 of the second cover 711*b* may come into contact with each other.

In this case, the first cover 711*a* and the second cover 711*b* are not located below the grill 63, and thus, the hole 61 (refer to FIG. 12) formed between the left surface of the side body 20 and the inner surface of the middle body 31 and the hole (refer to FIG. 12) between the right surface of the side body 20 and the inner surface of the middle body 31 may be opened. That is, the hole 61 may communicate with the first flow path 30*p*.

Meanwhile, the above-described fan 40 (refer to FIG. 12) may discharge air in an upper centrifugal direction in response to the rotation of the fan motor 42. That is, a part of the air discharged from the fan 40 may flow upward along the middle body 31 and may be introduced into the hole 61. Moreover, the remaining air discharged from the fan 40 may flow to the second flow path 20*p* (refer to FIG. 12) through the space between the first cover 711*a* and the hole 61, the space between the second cover 711*b* and the hole 61, and the space formed inside the middle body 31 in the front and rear of the first cover 711*a* and the second cover 711*b*.

That is, an air flow passing through the second flow path 20*p*, the opening 23 (refer to FIG. 6), and the first and second discharged ports 33*a* and 33*b* may be formed. However, since a flow rate and a flow velocity of the air passing through the hole 61 may be greater and faster than flow rates and flow velocities of the air passing through the first and second discharged ports 33*a* and 33*b*, as a whole, an air flow that is discharged from the hole 61 and raised may be formed.

Accordingly, the air discharged from the hole 61 may flow upward along the outer surface of the side body 20 between the side body 20 and the bending part 34 (refer to arrows indicated by dotted lines in FIG. 18).

Any or other embodiments of the present disclosure described above are not mutually exclusive or distinct. Certain embodiments or other embodiments of the present disclosure described above may be combined or combined with respective configurations or functions.

For example, it means that configuration A described in a specific embodiment and/or drawing and configuration B described in another embodiment and/or drawing may be coupled. That is, even when it is not directly explained about the coupling between the components, it means that the coupling is possible except for the case where it is described that the coupling is impossible.

The above detailed description should not be construed as restrictive in all respects and should be considered as illustrative. The scope of the present disclosure should be determined by a reasonable interpretation of the appended claims, and all modifications within the equivalent scope of the present disclosure are included in the scope of the present disclosure.

What is claimed is:

1. A blower comprising:

a fan configured to generate an air flow;

a lower body providing an inner space in which the fan is installed and having an intake hole through which air passes;

a side body located on the lower body and providing an inner space in which air discharged from the fan flows; and a rear body located at the rear of the side body, wherein the side body includes an opening formed at the rear end of the side body and communicating with the inner space of the side body, and the rear body covers a part of the side body at the rear of the opening, and wherein the blower further comprises:

a slit formed in the side body; and a damper installed in the inner space of the side body and opening or closing the slit.

2. The blower of claim 1, wherein the side body further includes:

a first side body having a first rear end adjacent to the rear body; and a second side body having a second rear end adjacent to the rear body and spaced apart from the first rear end, and the opening is formed between the first rear end and the second rear end.

3. The blower of claim 2, wherein the slit further includes:

a first slit passing through the first side body; and a second slit passing through the second side body, and the damper further includes:

a first damper adjacent to the first side body and opening or closing the first slit; and a second damper adjacent to the second side body and opening or closing the second slit.

4. The blower of claim 1, wherein the damper further includes:

a motor providing a rotational force;

a link connected to a rotation shaft of the motor and pivotable about the rotation shaft of the motor;

a body having a straight link hole into which an end of link is movably inserted and movable toward the slit; and a plate fixed to the body and having the same cross section as a shape of the slit.

5. The blower of claim 4, wherein the damper further includes:

a protrusion protruding outward from the body and extending in a direction crossing a longitudinal direction of the link hole; and a damper guide to which the protrusion is linearly movably coupled.

6. The blower of claim 4, wherein the link further includes:

an upper link; and a lower link located below the upper link, and a pivot direction of the upper link and a pivot direction of the lower link are different or opposite to each other.

7. The blower of claim 3, wherein the plate is inserted into the slit to close the slit and disposed in parallel with an outer surface of the side body adjacent to the slit.

8. The blower of claim 3, wherein the plate is inserted into the slit to close the slit and protrudes outward from an outer surface of the side body adjacent to the slit.

9. The blower of claim 3, wherein the plate is spaced apart from the slit to open the slit and disposed in the inner space of the slit body.

10. The blower of claim 1, further comprising an upper body located above the lower body and providing an inner space connecting the inner space of the lower body and the inner space of the side body, wherein the upper body includes a middle body covering a lower portion of the side body, and a hole is formed between the side body and the middle body.

11. The blower of claim 10, further comprising an inner damper installed in an inner space of the middle body and opening or closing the hole, wherein the inner space of the middle body forms a first flow path through which air discharged from the fan flows, the inner space of the side body forms a second flow path connected to the first flow path, and the hole communicates with the first flow path when the hole is opened by the damper.

12. A blower comprising:

a fan configured to generate an air flow;

a lower body providing an inner space in which the fan is installed and having an intake hole through which air passes;

a side body located on the lower body and providing an inner space in which air discharged from the fan flows; and a rear body located at the rear of the side body, wherein the side body includes an opening formed at the rear end of the side body and communicating with the inner space of the side body, and the rear body covers a part of the side body at the rear of the opening, wherein the blower further comprises an upper body located above the lower body and providing an inner space connecting the inner space of the lower body and the inner space of the side body, wherein the upper body includes a middle body covering a lower portion of the side body, a hole is formed between the side body and the middle body, and the blower further comprises an inner damper installed in an inner space of the middle body and opening or closing the hole, wherein the inner space of the middle body forms a first flow path through which air discharged from the fan flows, the inner space of the side body forms a second flow path connected to the first flow path, and the hole communicates with the first flow path when the hole is opened by the damper, and wherein the upper body further includes a bending part bent from the middle body toward the side body and disposed to be inclined with respect to the side body, and a gap between the side body and the bending part becomes narrower upward.

13. A blower comprising:

a fan configured to generate an air flow;

a lower body providing an inner space in which the fan is installed and having an intake hole through which air passes;

a side body located on the lower body and providing an inner space in which air discharged from the fan flows; and a rear body located at the rear of the side body, wherein the side body includes an opening formed at the rear end of the side body and communicating with the inner space of the side body, and the rear body covers a part of the side body at the rear of the opening, wherein the blower further comprises an upper body located above the lower body and providing an inner space connecting the inner space of the lower body and the inner space of the side body, wherein the upper body includes a middle body covering a lower portion of the side body, a hole is formed between the side body and the middle body, and the blower further comprises an inner damper installed in an inner space of the middle body and opening or closing the hole, wherein the inner space of the middle body forms a first flow path through which air discharged from the fan flows, the inner space of the side body forms a second flow path connected to the first flow path, and the hole communicates with the first flow path when the hole is opened by the damper, and wherein the inner damper further includes:

a motor providing a rotational force;

a pinion connected to a rotation shaft of the motor;

a rack being elongated and engaging the pinion; and a cover to which the rack is fixed and which is disposed below the hole and movable in a longitudinal direction of the rack together with the rack, and the cover comes into contact with an inner surface of the middle body to close the hole or is spaced apart from the middle body to open the hole.

14. The blower of claim 13, wherein the inner damper further includes:

a front rail installed on the cover and having a front slot elongated in the longitudinal direction of the rack;

a rear rail installed on the cover, spaced apart from the front rail, and having a rear slot elongated in a longitudinal direction of the rack;

a first pin fixed to the middle body and movably inserted into the front rail; and a second pin fixed to the middle body and movably inserted into the rear rail.

15. The blower of claim 13, wherein the inner damper further includes a mount on which the motor is installed and in which a mount hole communicating with the first flow path is formed, and the mount hole is spaced apart from the hole in a moving direction of the cover.

* * * * *